US011802431B2

(12) United States Patent
Ogawa

(10) Patent No.: US 11,802,431 B2
(45) Date of Patent: Oct. 31, 2023

(54) DOCUMENT COVER CLOSER AND OFFICE EQUIPMENT USING THE SAME

(71) Applicant: KEM HONGKONG LIMITED, Tsimshatsui-Kowloon (HK)

(72) Inventor: Satoshi Ogawa, Kanagawa (JP)

(73) Assignee: KEM HONGKONG LIMITED, Tsimshatsui-Kowloon (HK)

( * ) Notice: Subject to any disclaimer, the term of this patent is extended or adjusted under 35 U.S.C. 154(b) by 164 days.

(21) Appl. No.: 17/487,522

(22) Filed: Sep. 28, 2021

(65) Prior Publication Data

US 2022/0127889 A1 Apr. 28, 2022

(30) Foreign Application Priority Data

Oct. 27, 2020 (JP) ..... 2020-179562

(51) Int. Cl.
*E05F 1/12* (2006.01)

(52) U.S. Cl.
CPC ..... *E05F 1/1246* (2013.01); *E05Y 2900/606* (2013.01)

(58) Field of Classification Search
CPC ..... E05F 1/1246; E05Y 2900/606
See application file for complete search history.

(56) References Cited

U.S. PATENT DOCUMENTS 6,415,477 B1 * 7/2002 Hosaka ..... E05F 1/1261 16/284
6,629,336 B2 * 10/2003 Hosaka ..... E05F 3/20 16/284
7,900,320 B2 * 3/2011 Katsumata ..... G03G 15/60 355/75
8,457,527 B2 * 6/2013 Takata ..... G03G 15/605 399/125
8,973,218 B2 * 3/2015 Yabukoshi ..... E05F 1/1261 16/281
10,788,785 B2 * 9/2020 Kondo ..... G03G 15/60
2006/0000056 A1 * 1/2006 Connors ..... H04N 1/00519 16/65
2006/0085946 A1 * 4/2006 Hattori ..... H04N 1/00554 16/221
2006/0130277 A1 * 6/2006 Nelson ..... E05F 1/1261 16/327
2018/0196385 A1 * 7/2018 Kondo ..... H04N 1/00554
(Continued)

FOREIGN PATENT DOCUMENTS

JP 2001-154287 A 6/2001

*Primary Examiner* — Jason W San
(74) *Attorney, Agent, or Firm* — Notaro, Michalos & Zaccaria P.C.

(57) ABSTRACT

A document cover closer and office equipment using the same are disclosed. The document cover closer includes an attaching part, which includes an attaching base and two side plates. The attaching part is attached to a main body. A supporting part includes a back plate and two side plates. The side plates of the supporting part are rotatably coupled via a hinge shaft to the side plates of the attaching part. A lift part includes a back plate and two side plates. The side plates of the lift part are pivotally attached via a coupling shaft to the free end side of the side plates of the supporting member. An actuating part is provided on the pivotally attaching portion of the lift part so as to rotate about the coupling shaft when the lift part rotates.

11 Claims, 14 Drawing Sheets

(56) References Cited

U.S. PATENT DOCUMENTS

| | | | | |
|---|---|---|---|---|
| 2018/0347247 | A1* | 12/2018 | Kondo | E05D 5/02 |
| 2019/0023041 | A1* | 1/2019 | Brown | B41J 29/02 |
| 2019/0094791 | A1* | 3/2019 | Kondo | G03G 21/1633 |
| 2022/0127889 | A1* | 4/2022 | Ogawa | E05D 11/1014 |

* cited by examiner

DOCUMENT COVER CLOSER AND OFFICE EQUIPMENT USING THE SAME

RELATED APPLICATION

This application claims priority on Japanese Patent Application No. 2020-179562 filed Oct. 27, 2020, which claim is repeated herein.

FIELD OF THE INVENTION

The invention relates to a document cover closer suitable in use for opening and closing a document cover of office equipment, such as copying machine, printer, etc.; the invention also relates to office equipment using such a document cover closer.

BACKGROUND ART

Conventionally a document cover closer and office equipment using such a document cover closer is known from JP Laid-Open Patent Application No. 2001-154287, wherein the document cover closer comprises an attaching member comprising an attaching base and both side plates directed upward from both sides of the attaching base, with the attaching base being attached to a main body; a supporting member comprising at least a back plate and both side plates directed downward from the back plate, with the both side plates being coupled via a hinge shaft to the both side plates of the attaching member; a lift member comprising a back plate to which a document cover is attached, both side plates directed downward from the back plate and attaching plates directed outward from the both side plates, with its both side plates being pivotally attached via a coupling shaft to be rotatable in a direction different from that of the supporting member on the free end of the both side plates of the supporting member; an actuating member provided toward a pivotally attaching portion of the lift member with regard to the supporting member, at a position at which the lift member rotates about the coupling shaft; a pressed member pivoted between the both side plates of the attaching member at a position different from the hinge shaft; a cam slider slidably housed in the supporting member, with its cam portion abutting against the pressed member; a spring receiving member slidably housed in the supporting member toward the free end, with abutting against the actuating member; and an elastic member rotationally urging the lift member in a direction in which the latte r moves to overlap the supporting member, while urging the supporting member in an opening direction of the document cover, wherein rotation control means for restricting the maximum opening angle of the document cover are designed to have the back plate of the supporting member abut against a stopper plate attached to a rear plate of the attaching member.

As shown in FIG. 14, a document cover closer I according to an above-mentioned patent document comprises an attaching member for attaching its attaching base 30*a* to a main body a; a supporting member 31, wherein its both side plates 31*b* are coupled via a hinge shaft 32 to the both side plates 30*b* of the attaching member 30; a lift member 34 for attaching a document cover K, wherein its both side plates are pivotally attached via a coupling shaft to be rotatable in a direction different from that of the supporting member 31 on the free end of the both side plates 31*b* of the supporting member 31; a pressed member 40 put over the both side plates 30*b* of the attaching member 30; a cam slider 41 slidably housed in the supporting member, with its cam portion 41*a* abutting against the pressed member 40; an actuating member 38 provided between the both side plates 34*b* of the lift member 34; a spring receiving member 39 slidably housed in the supporting member 31, with abutting against the actuating member 38; and an elastic member 33 housed in the supporting member 31 and resiliently provided between the cam slider 41 and the spring receiving member 39 to rotationally urge the lift member 34 in a direction in which the latter moves to overlap the supporting member 31, while urging the supporting member 31 at least in an opening direction of the document cover K, wherein a stopper plate 35 having a pair of stopper pieces 35*a* is attached to arear plate 30*c* of the attaching member by attaching screws 36.

As designed in this manner, while a document cover K is opened and closed, it enables a smooth operation without giving a feel of an own weight of the document cover K by a resilient force of an elastic member 33, still further, if the document is a thick document such as a book, it enables a horizontal covering of a top surface of the thick document by a reverse rotation of a lift member 34 relative to a supporting member 31 against the resilient force of the elastic member 33.

During a normal closing operation of a document cover K, an elastic member 33 presses via a spring receiving member 39 and an actuating member 38 a lift member 34 such that the latter cannot rotate reversely together with the document cover K, in order to thus prevent a phenomenon of center folding (i.e. that in which the document cover K reversely rotates about a coupling shaft 37). However, this phenomenon of center folding sometimes occurs, either due to a direction of closing force while closing the document cover K or in case of vigorously closing it.

If one tries to suppress a phenomenon of center folding in these cases, a solution is found in increasing a lift operation force while starting an operation to some degree, but this solution causes another problem of increasing the force to the maximum lift state.

SUMMARY OF THE INVENTION

The present invention is intended to solve a problem with a conventional art as described above, and has an object to provide a document cover closer capable of preventing a phenomenon of center folding of a document cover during a normal closing operation of the document cover and of normally decreasing an operation force while lifting other than starting an operation, as well as office equipment using the document cover closer.

To achieve an object as mentioned above, a document cover closer according to the invention is characterized in that it comprises an attaching member comprising an attaching base and both side plates directed upward from both sides of the attaching base, wherein the attaching member is attached to a main body having a platen glass; a supporting member comprising at least a back plate and both side plates directed downward from the back plate, wherein the both side plates are rotatably coupled via a hinge shaft to the both side plates of the attaching member;

a lift member for attaching a document cover comprising at least a back plate and both side plates directed downward from the back plate, wherein its both side plates are pivotally attached via a coupling shaft to be rotatable in a direction different from that of the supporting member on the free end of the both side plates of the supporting member and the lift member comprises an actuating member on a pivotally attaching portion; a cam slider slidably provided in the supporting member in contact with a pressed member provided between the both side plates of the attaching member and with being held by holding portions; a spring receiving member slidably provided toward the coupling shaft on the supporting member, with being held by holding portions; and an elastic member rotationally urging the supporting member in an opening direction of the document cover; and the actuating member in contact with the spring receiving member provided on the pivotally attaching portion of the lift member relative to the supporting member wherein it further comprises rotation resisting means exhibiting resistance to rotation when the lift member is subject to a pressing force in a direction in which it reversely rotates relative to the supporting member about the coupling shaft, in order to horizontally cover a top side of a thick document.

Here, a document cover closer according to the second aspect is characterized in that rotation resisting means are composed of a pressurizing contact mechanism for bringing a supporting member and a spring receiving member, when a supporting member and a lift member overlap each other.

Furthermore, a document cover closer according to the third aspect is characterized in that a pressurizing contact mechanism is composed of first pressing portions provided on a top end toward a bottom portion of a back plate of a supporting member, and of second pressing portions provided toward a spring receiving member at a position where a spring receiving member is in pressurized contact with first pressing portions.

Still further, a document cover closer according to the fourth aspect is characterized in that first pressing portions and second pressing portions are respectively a plurality of ridges arranged in parallel to extend in parallel to each other.

Still further, a document cover closer according to the fifth aspect is characterized in that a pressurizing contact mechanism is composed of a convex portion or concave portion provided on a top portion toward a bottom portion, and of a concave portion or convex portion fitting the convex portion or concave portion provided toward a spring receiving member at a position where the spring receiving member is in pressurized contact with the first pressing portions.

Still further, a document cover closer according to the sixth aspect is characterized in that rotation resisting means are provided between a supporting member and a lift member to increase a resistance to a rotation of the lift member while the lift member rotates relative to the supporting member.

Still further, a document cover closer according to the seventh aspect is characterized in that rotation resisting means are provided between an actuating member and a supporting member to increase a resistance to a rotation of the actuating member while the lift member starts to rotate relative to the supporting member.

Still further, a document cover closer according to the eighth aspect is characterized in that while providing rotation resisting means between an actuating member and a supporting member, rotation resisting means are composed of guide grooves provided on both side plates of the supporting member and of the actuating member to be inserted into the guide grooves.

Still further, a document cover closer according to the ninth aspect is characterized in that a reinforcing member is attached to a lift member over a space between its both side plates.

Still further, a document cover closer according to the tenth aspect is characterized in that a braking mechanism starting to have an effect from a predetermined opening angle of a supporting member is provided between the supporting member and a cam slider.

Still further, a document cover closer according to the eleventh aspect is characterized in that a braking mechanism is a projecting portion provided toward a bottom portion of a back plate of a supporting member to be directed to a cam slider.

Then the invention according to the twelfth aspect is characterized in that it is office equipment wherein a document cover closer according to one of aspects as mentioned above is used between a main body and a document cover.

A document cover closer according to a first aspect of the invention can have an effect that when a force is applied to a lift member attached to be reversely rotatable about a coupling shaft relative to a supporting member in order to handle a thick document such as a book, rotation of the lift member for reverse rotation about the coupling shaft is further restrained by a rotation resisting mechanism at start of its movement to be able to prevent a phenomenon of center folding of a document cover, so that there is no need to enhance a resilient force of an elastic member as compared to a conventional one.

In a document cover closer according to a second aspect of the invention a rotation resisting mechanism is a pressurizing contact mechanism provided between a supporting member and a spring receiving member, so that the rotation resisting mechanism can move only in a reverse rotation movement of a lift member and it is released from a pressurized contact state by a pressurizing contact mechanism to decrease an operation force as in a conventional one.

In a document cover closer according to a third aspect of the invention first pressing portions are formed on a back plate of a supporting member, second pressing portions on an upper end of a spring receiving member and holding portions extends along an extension direction of an elastic member on lower ends of both side plates of the supporting member and formed to face the both side plates of the supporting member, so that the spring receiving member are pressed by the first pressing portions and the second pressing portions toward the holding portions to prevent a phenomenon of center folding of a document cover in a normal opening and closing operation, and to decrease an operation force as in the normal operation.

In a document cover closer according to a forth aspect of the invention first pressing portions and second pressing portions are so that the spring receiving member is pressed by the first pressing portions and the second pressing portions toward the holding portion to prevent a phenomenon of center folding of a document cover in a normal opening and closing operation, and to decrease an operation force as in the normal operation.

In a document cover closer according to a fifth aspect of the invention a convex portion or concave portion provided on a back plate of a supporting member and a concave portion or convex portion provided on an upper portion are fitted with each other, so that it exhibits a resistance to rotation, which allows to achieve an object of the invention also in this manner.

In a document cover closer according to a sixth aspect of the invention an arrangement of a rotation resisting mechanism between a supporting member and a spring receiving member allows to achieve an object of the invention.

In a document cover closer according to a seventh aspect of the invention an arrangement of a rotation resisting mechanism between an actuating member and a supporting member also allows to achieve an object of the invention.

In a document cover closer according to a eighth aspect of the invention the width of inlet parts of guide grooves into which an actuating member is inserted is narrowed, so that there arises a resistance to a passage of the actuating member into the guide grooves to be able to increase a resistance to a rotational movement of a lift member at start of its rotation.

In a document cover closer according to a ninth aspect of the invention a lift member is equipped with a reinforcing member over a space between its both side plates to be able to prevent a deformation of the lift member due to its longtime use.

In a document cover closer according to a tenth and an eleventh aspects of the invention a braking mechanism can prevent a sudden jumping up of a document cover at its opening operation.

According to a twelfth aspects of the invention document cover closer according to one of aspects as mentioned above is used in office equipment between a main body and a document cover to be able to prevent a phenomenon of center folding of a document cover in a normal opening and closing operation, and to decrease an operation force except the start of its operation as in the normal operation.

EMBODIMENTS

The drawings show an embodiment of the invention. In the meantime, reference is made to a document cover closer used in a copying machine or a multifunction printer, but the document cover closer according to the invention can be also used as a document cover closer in a printer, facsimile, scanner other than the copying machine or the multifunction printer. In the meantime, terms as abutment member, pressed member or actuating member are used, because these terms contain broader concepts as described in the detailed description of the invention, in particular abutment pin, pressurized pin or actuating pin and so on.

Figure 1:
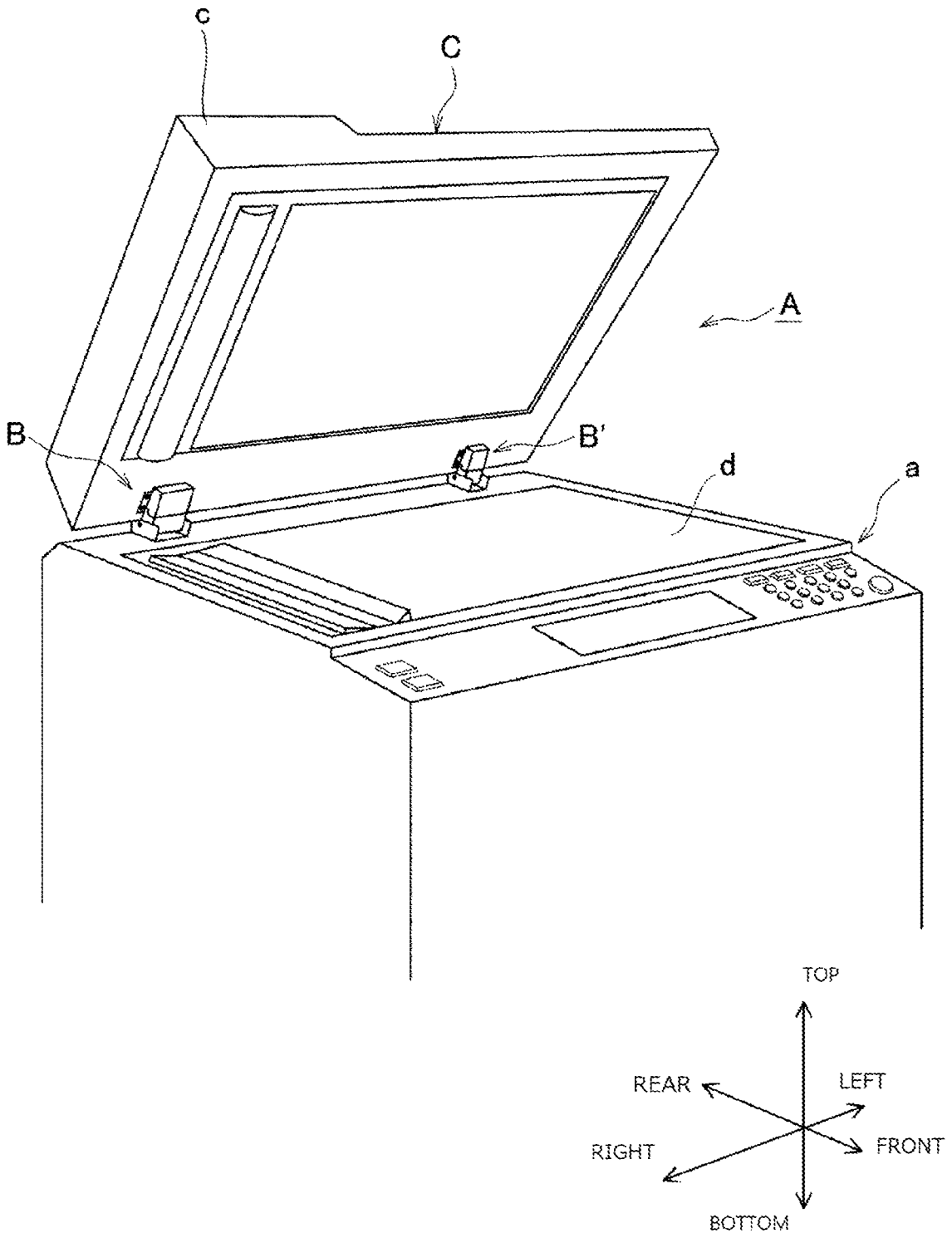
FIG. 1 shows a perspective view schematically illustrating a multifunction printer being an example of office equipment using a document cover closer according to the invention.

FIG. 1 shows a perspective view schematically illustrating a multifunction printer being an example of office equipment using a document cover closer according to the invention. According to the drawings, a document cover C with an automatic document feeder c is attached via a pair of document cover closers B, B' onto a main body a of a multifunction printer A. Of these document cover closers B, B', one document cover closer B equipped with the automatic document feeder c assumes a greater load applied in an opening and closing operation, so that it uses as elastic member 12 triple coil springs 12*a*, 12*b*, 12*c* of different diameters concentrically disposed one inside the other. A document cover closer B' assumes a smaller load, thus it is normally of single coil spring design consisting of one coil spring, though not shown. In the meantime, reference is made as necessary to directions as a front and rear, a right and left, and a top and bottom in what follows.

FIGS. 2 to 13 show an example of a document cover closer B according to an embodiment. A document cover closer B comprises an attaching member 1 attached to a main body a; a supporting member 2, wherein its both side plates 2*b*, 2*b* are coupled via a hinge shaft 3 to the both side plates 1*b*, 1*b* of the attaching member 1; a lift member 6 for attaching a document cover C, wherein its both side plates 6*b*, 6*b* are pivotally attached via a coupling shaft 4 to be rotatable in a direction different from that of the supporting member 2 on the free end of the both side plates 2*b*, 2*b* of the supporting member 2; a pressed member 5 put over the both side plates 1*b*, 1*b* of the attaching member 1; a cam slider 10 slidably housed in the supporting member 2, wherein the cam slider is held by holding portions 2*c*, 2*c* and its cam portion 10*a* abuts against the pressed member 5; an actuating member 9 provided between the both side plates 6*b*, 6*b* of the lift member 6; a spring receiving member 11 slidably housed in the supporting member 2, wherein it abuts against the actuating member 9; and an elastic member 12 housed in the supporting member 2 and resiliently provided between the cam slider 10 and the spring receiving member 11 to rotationally urge the lift member 6 in a direction in which the latter moves to overlap the supporting member 2, while urging the supporting member 2 at least in an opening direction of the document cover C.

As shown in FIGS. 5, 7, 8, 9 and 10, first pressing portions 2*j* and second pressing portions 11*d* which face each other to be able to press a spring receiving member 11 are formed on a supporting member 2 and the spring receiving member 11. A document cover closer B can prevent a phenomenon of center folding of a document cover C by arranging the first pressing portions 2*j* and the second pressing portions 11*d* to face each other to press a spring receiving member 11 (to be described below in detail). Still further, in order to operate a lift member 6 in using a thick document such as book, just a smaller force (force in a normal lifting operation) is required after the spring receiving member 11 is released from a state where the first pressing portions 2*j* and the second pressing portions 11*d* face each other to press it, as compared to a moment when the spring receiving member 11 is getting released from a state where the first pressing portions 2*j* and the second pressing portions 11*d* face each other to press it. In the following a document cover closer B is described further in detail.

Figure 4:
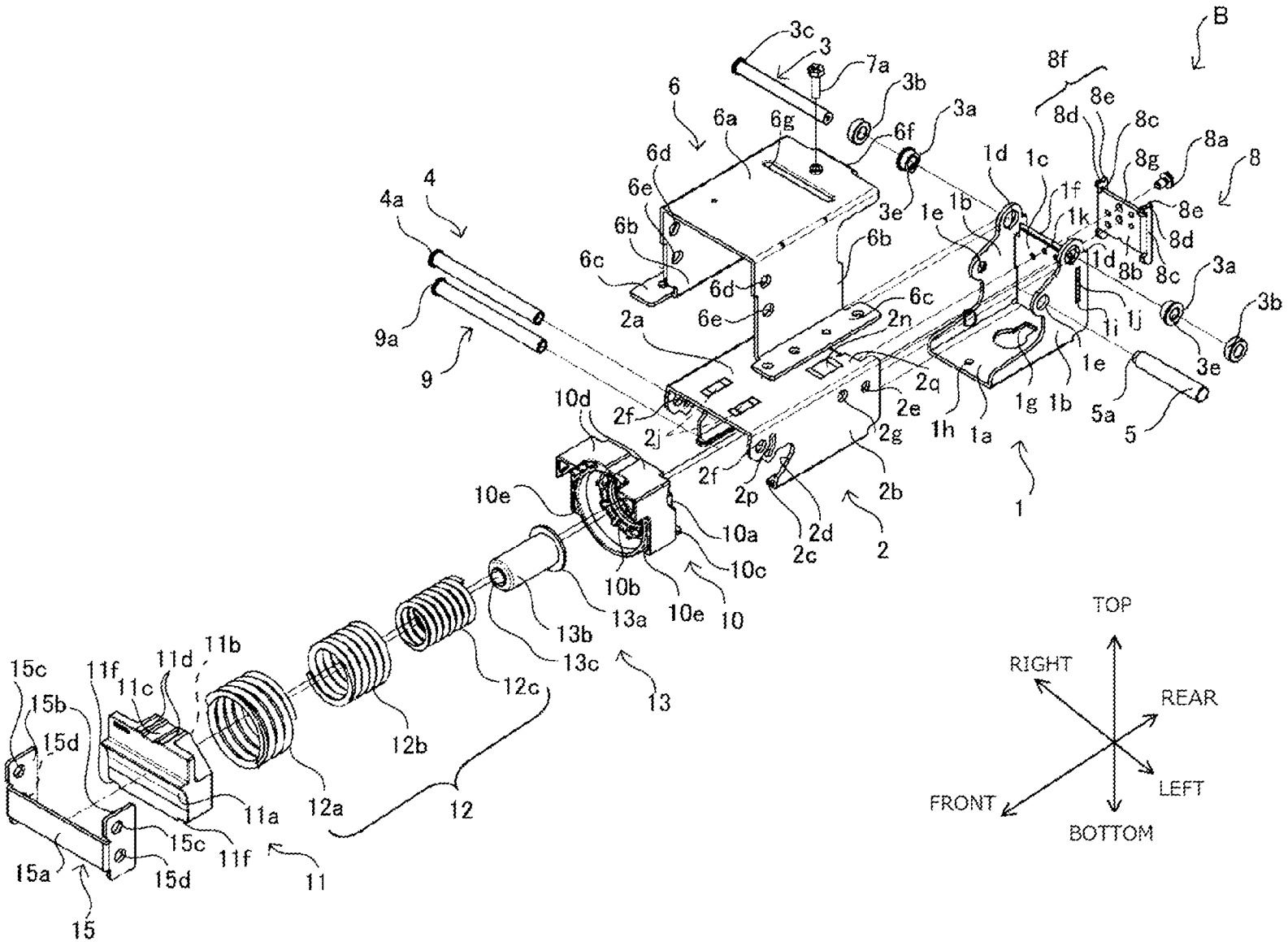
FIG. 4 shows an exploded perspective view of a document cover closer according to the invention.
Figure 9A:
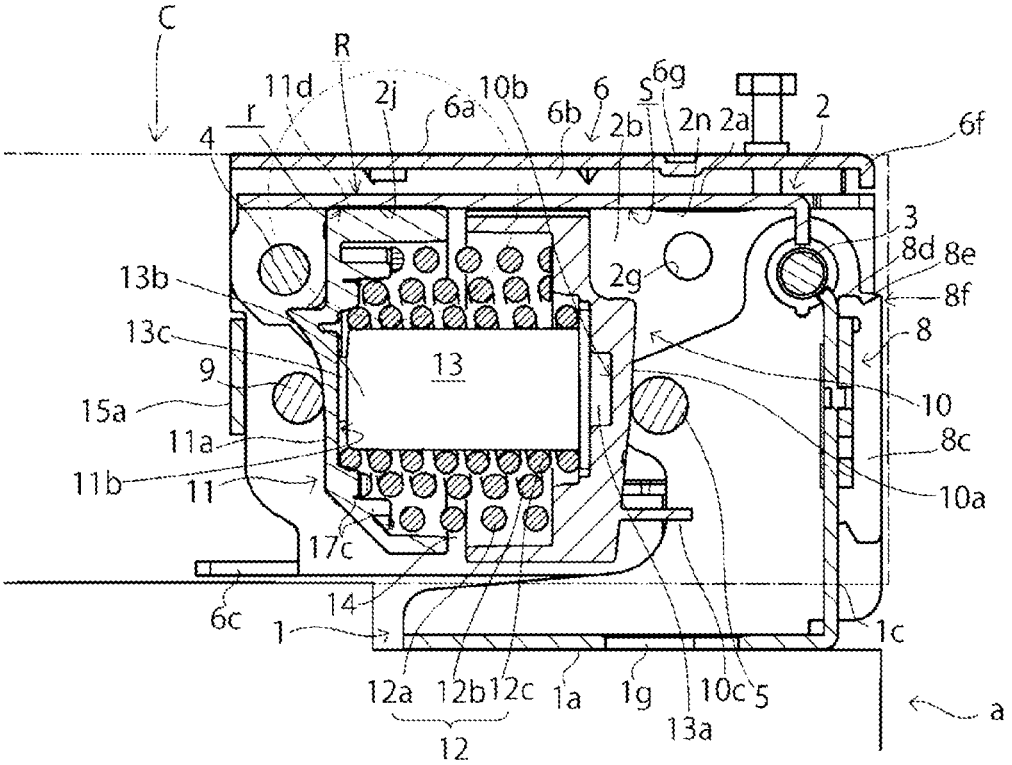
FIGS. 9A and 9B illustrate an operation a document cover closer according to the invention, FIG. 9A showing a side cross section of its closed state, and FIG. 9B—an enlarged view of a part denoted with O in dotted line of FIG. 9A.
Figure 9B:
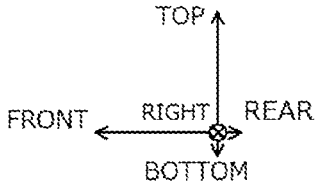
Figure 9B:
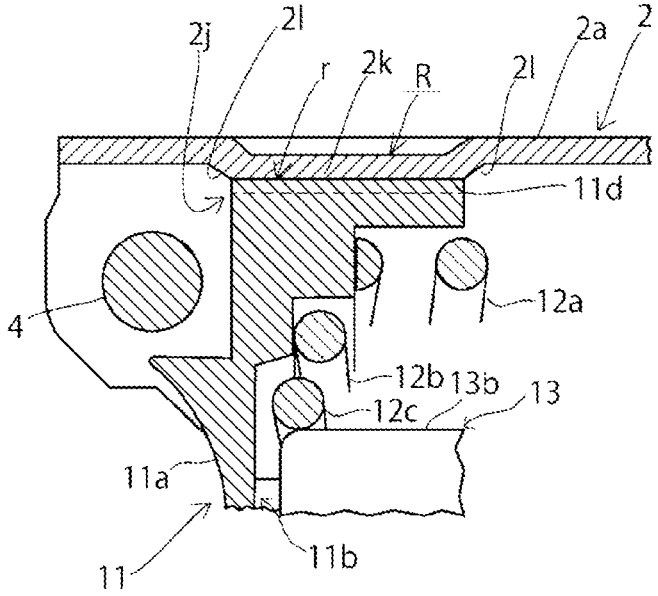

As shown in FIGS. 4, 9 and others, an attaching member 1 comprises an attaching base 1*a* attached onto a main body a, both side plates 1*b*, 1*b* respectively directed in a direction to the top perpendicular (also substantially perpendicular) to the attaching base 1*a* from both side end portions of the attaching base 1*a*, and a substantially rectangular rear plate 1*c* directed in a direction to the top perpendicular (also substantially perpendicular) to the attaching base 1*a* from one end portion (rear end portion) of the attaching base 1*a*, wherein its locking pieces 1*j*, 1*j* are locked on locking grooves 1*i*, 1*i* provided on the both side plates 1*b*, 1*b* of the attaching member 1. As necessary, in order to fix a position of the maximum opening angle of 90 degrees of a supporting member 2 during an opening and closing operation of a document cover C, a stopper plate 8 is attached via an attaching screw 8*a* to the rear plate 1*c*. Further, reference numerals 1*d*, 1*d* denote hinge shaft attaching holes, and numerals 1*e*, 1*e*—pressed member attaching holes. Still further, attaching holes 1*g*, 1*h* into which attaching screws (not shown) when the attaching base 1*a* is attached to the main body a are provided on the attaching base 1*a*.

Figure 2:
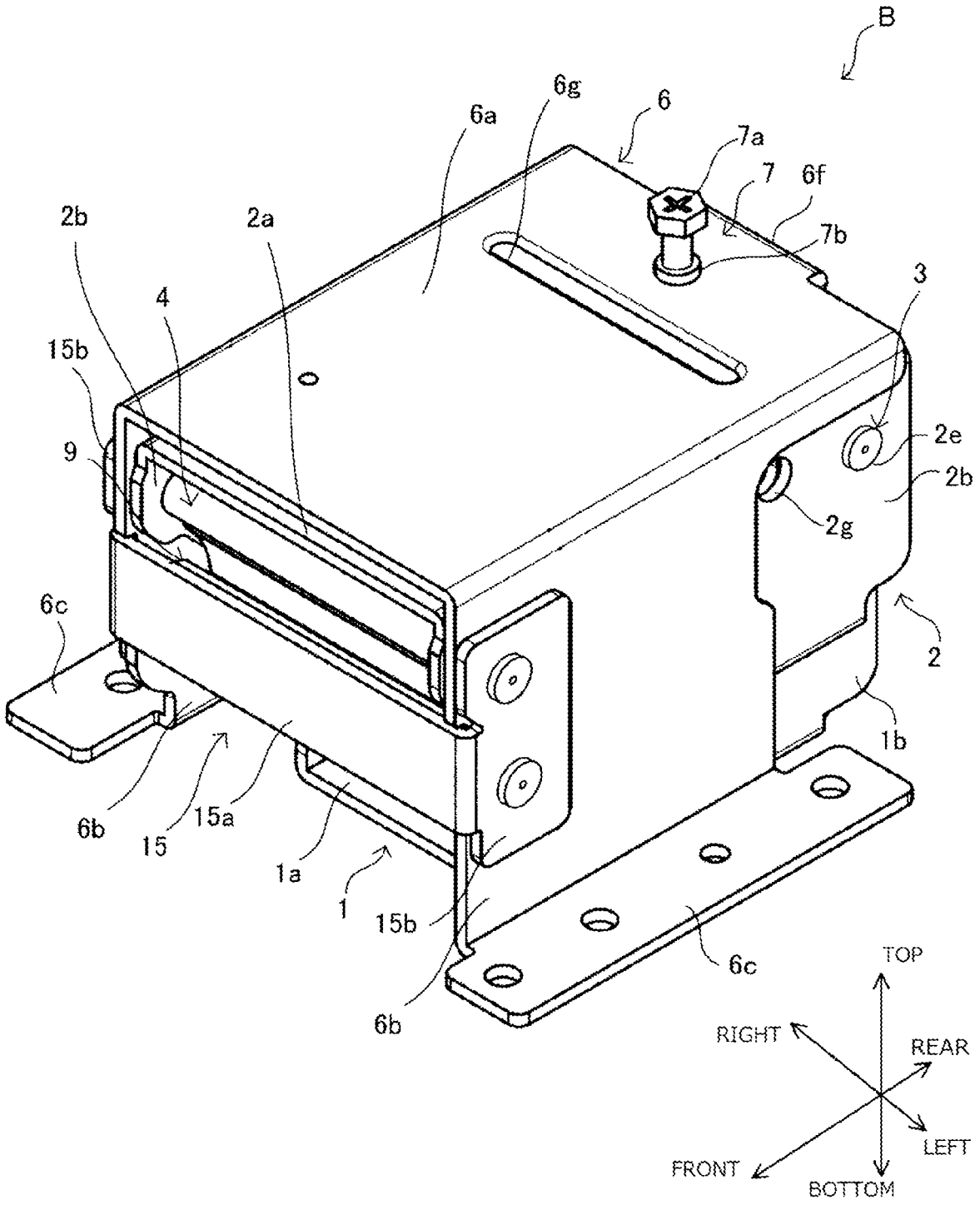
FIG. 2 shows a perspective view illustrating a document cover closer according to the invention as seen from the front side.
Figure 7A:
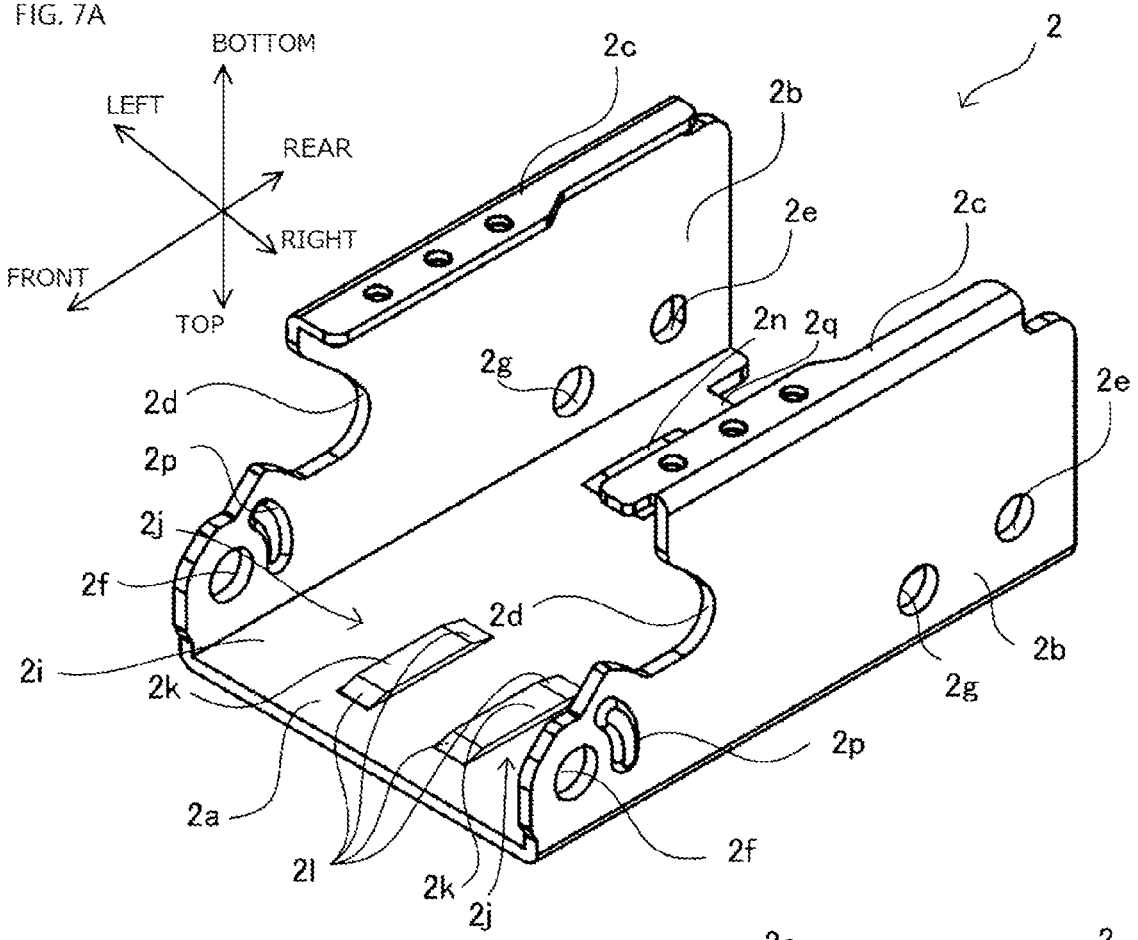
FIGS. 7A and 7B show a supporting member of a document cover closer according to the invention, FIG. 7A showing a perspective view as seen from the front side of its bottom surface, and FIG. 7B—a perspective view as seen from the rear side of its bottom surface.
Figure 7B:
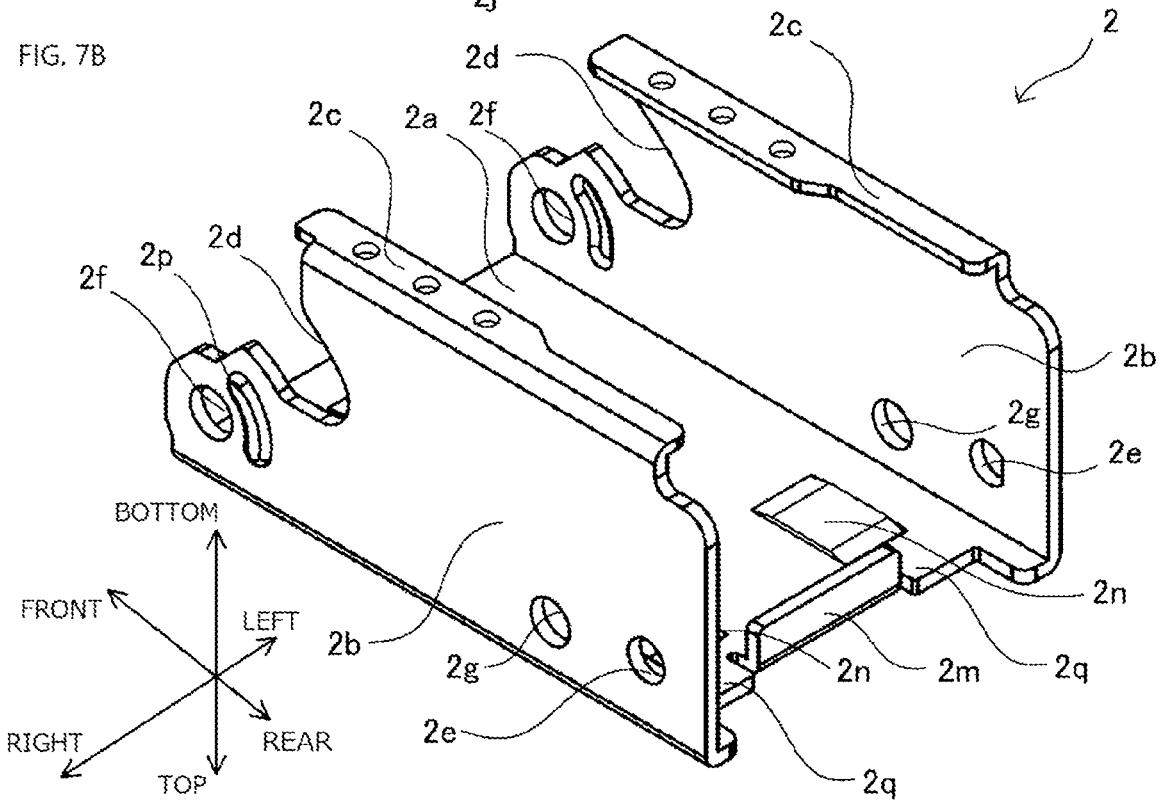

As shown in FIGS. 7A and 7B, a supporting member 2 comprises a back plate 2*a*, both side plates 2*b*, 2*b* directed downward from both end portions of the back plate 2*a*, and holding portions 2*c*, 2*c* both directed inward from lower ends of the both side plates 2*b*, 2*b*. As shown in FIGS. 2 and 4, the both side plates 2*b*, 2*b* are rotatably coupled to both side plates 1*b*, 1*b* of an attaching member 1 by a hinge shaft 3. Guide grooves 2*d*, 2*d* are provided on the free end sides of the both side plates 2*b*, 2*b*, wherein a lift member 6 is pivotally attached via a coupling shaft 4 to be rotatable, and both end sides of an actuating member 9 is inserted herein.

Referring back to FIGS. 7A and 7B, reference numerals 2*e*, 2*e* denote hinge shaft insertion holes, numerals 2*f*, 2*f*—coupling shaft insertion holes, and numerals 2*g*, 2*g*—stopper holes for assembly. First pressing portions 2*j*, 2*j* formed in vicinity of a front end portion on a surface 2*i* facing downward of a back plate 2*a* are projecting portions extending in parallel to each other along an extending direction of an elastic member 12, and capable of facing second pressing portions 11*d*, 11*d* to press each other. On the first pressing portions 2*j*, 2*j*, a protruding portion 2*k* protruding the most from the surface 2*i* and inclined portions 2*l* with protrusion increasing or decreasing in a tapered manner are provided. An abutting portion 2*q* adjacent to a rear plate 2*m* extending downward from a rear end portion of the back plate 2*a* and both ends of the rear plate 2*m* is an element for controlling the maximum opening angle during a rotation of a supporting member 2 about a hinge shaft 3 (see FIG. 13). At the maximum opening angle the rear plate 2*m* abuts against a protruding portion if on a top end of a rear plate 1*c* and abutting portions 2*q*, 2*q* to be described below abut against respective rear ends of concave portions 8*e*, 8*e* of a stopper plate 8 to control a rotation of the supporting member 2.

As shown in FIG. 4, projecting portions 2*n*, 2*n* formed in vicinity of a rear end portion of a surface 2*i* of a back plate 2*a* constitute a braking mechanism S having a braking effect by pressing top surfaces 10*d*, 10*d* of a cam slider 10 and pressing held portions 10*e*, 10*e* on bottom portions on right and left ends of the cam slider 10. When a supporting member 2 is at a predetermined opening angle, the cam slider 10 is pressed by the projecting portions 2*n*, 2*n* to increase a force required for an opening operation of the supporting member 2 and to suppress a sudden opening of a document cover C or to increase a tolerance range for stable retention of the document cover C by decrease in rotation speed. Curved convex portions 2*p*, 2*p* being arc-shaped convex portions formed along a portion of a circumference of coupling shaft insertion holes 2*f*, 2*f* to protrude outwardly from both side plates 2*b* are convex portions for preventing a backlash.

As shown in FIGS. 2, 4 and others, a hinge shaft 3 is a metallic round bar with a flange portion 3*c*, which passes through bearing holes 3*e*, 3*e* of bearing members 3*a*, 3*a* attached to hinge shaft attaching holes 1*d*, 1*d* of an attaching member 1 to couple hinge shaft insertion holes 2*e*, 2*e* of a supporting member 2, and is attached to both end portions protruding from the hinge shaft insertion holes 2*e*, 2*e* via collars 3*b*, 3*b*.

Figure 3:
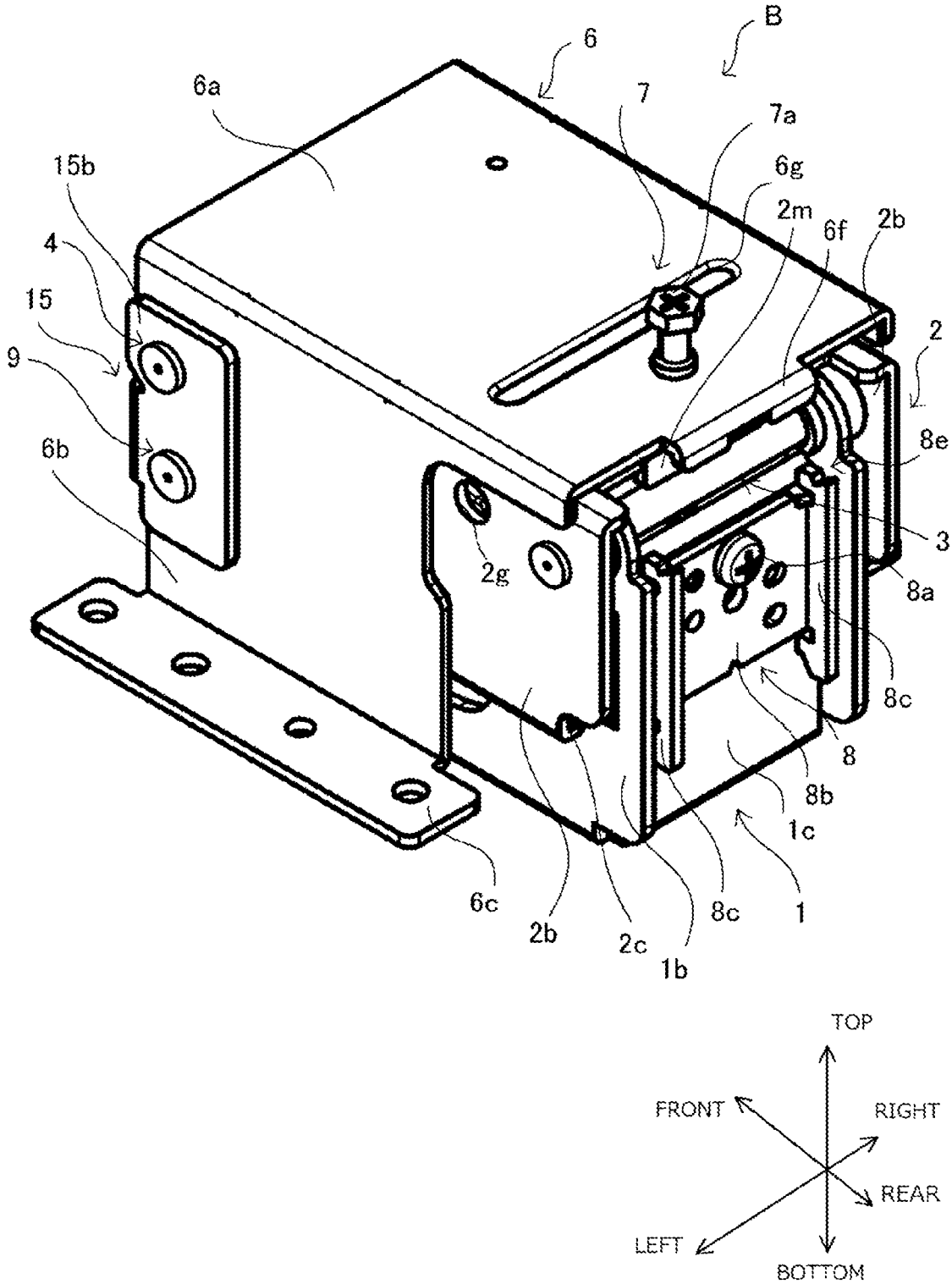
FIG. 3 shows a perspective view illustrating a document cover closer according to the invention as seen from the rear side.

As shown in FIGS. 2, 3, 4 and others, a lift member 6 is composed of a back plate 6*a*, both side plates 6*b*, 6*b* directed downward in a direction perpendicular (also substantially perpendicular) to the back plate 6*a* from both side end portions of the back plate 6*a*, attaching plate portions 6*c*, 6*c* directed further outwardly from the both side plates 6*b*, 6*b*, and constructed to cover a supporting member 2. In accordance with the structure according to the invention, a bar-like actuating member 9 is attached onto a side where the lift member 6 is pivotally attached by a coupling shaft 4, and a document cover C is attached to the attaching plate portions 6*c*, 6*c*. In the meantime, height adjusting means 7 are composed of an adjusting screw 7*a* attached to the back plate 6*a* and a nut 7*b*; these are intended to finely adjust the height of the document cover C relative to a platen glass (contact glass) d in order to assure a uniformly pressurized contact with a top surface of the platen glass (contact glass) d. Furthermore, a stopper portion 6*f* is an element abutting against a head portion of an attaching screw 8*a* depending on the degree of adjustment of the adjusting screw 7*a*. A concave portion 6*g* is prolonged along an axial direction of the coupling shaft 4 to enhance the strength of the lift member 6.

A coupling shaft 4 is a metallic round bar and has an enlarged diameter portion 4*a*; it is inserted into coupling shaft insertion holes 2*f*, 2*f* of a supporting member 2 and coupling shaft coupling holes 6*d*, 6*d* of a lift member 6, and coupled such that the lift member 6 is rotatable relative to the supporting member 2 in a direction (direction b in FIG. 13) reverse to a rotation direction of the supporting member 2. The coupling shaft 4 is attached to the lift member 6 by caulking its other end portion protruding from both side plates 6*b*.

As shown in FIG. 4, a pressed member 5 is a metallic round bar-shaped pressurized pin put over both side plates 1*b*, 1*b* of an attaching member 1. The pressed member 5 has one end portion on which a smaller diameter portion 5*a* of a smaller diameter is formed, and the other end portion formed to be long enough to protrude from the both side plates 1*b*. The smaller diameter portion 5*a* is inserted into the both side plates 1*b* and a portion of the other end protruding from the both side plate 1*b* is caulked to attach the pressed member 5 to a supporting member 2. In the meantime, the material of the pressed member 5 is not limited to metal, but can also include synthetic resin, ceramic, machine-processed product and others. Still further, the pressed member 5 can be constructed to include a pressurized pin and a slide roller e.g. of synthetic resin rotatably attached to the pressurized pin with the pressurized pin being inserted into an insertion hole provided in an axial direction.

In the meantime, the pressed member 5 can be fixed to pressed member attaching holes 1*e*, 1*e* by caulking both end portions or restrained from escape using E-rings. Still further, it can be rotatably attached to the pressed member attaching holes 1*e*, 1*e*. Still further, the pressed member 5 can be composed of the pressurized pin and the slide roller; the material of the slide roller is preferably synthetic resin, ceramic, machine-processed product and others. Still further, the slide roller can comprise a cam portion constructed in a curved round shape, and a slide contact portion abutting against the cam portion can be constructed in a shape enabling a surface contact with the round shape of the cam portion. Still further, the pressed member 5 can be a cam member e.g. of resin attached between both side plates 1*b*, 1*b*, or a press-processed curved member provided with a curve equally between the both side plates 1*b*, 1*b*.

A cam slider 10 and a spring receiving member (elastic member receiving member) 11 are held by holding portions 2*c*, 2*c* and slidably housed in a supporting member 2. According to the embodiment, the cam slider 10 and the spring receiving member 11 are formed in the shape of bottomed cylindrical body with a substantially rectangular cross section; a cam portion 10*a* inclined in one direction with a flat top surface is provided on the cam slider 10 where a pressed member 5 is exposed as well as a cover portion 10*c* for covering where the pressed member 5 is exposed, in order to prevent stains on a document set on a platen glass d due to lubricant oil applied on the pressed member 5. An abutting portion 11*a* is formed with a substantially arc-shaped cross section on one end portion of the spring receiving member 11 facing an actuating member 9, so that its top side protrudes toward the actuating member 9. In the meantime, the abutting portion 11*a* is not indispensable, but can be a uniformly flat portion. The cam slider 10 and the spring receiving member 11 are slidably housed in a supporting member 2, with their respective openings 10*b*, 11*b* facing each other; the cam portion 10*a* of the cam slider 10 abuts against the pressed member 5, while an abutting portion 11*a* of the spring receiving member 11 abuts against the actuating member 9. In the embodiment, the actuating member 9 has the shape of shaft attached between both side plates 6*b*, 6*b* of a lift member 6, but it is also possible that a front plate is provided on the lift member 6, and the actuating member can be provided on the front plate.

An elastic member 12 consisting of a large diameter coil spring 12*a*, an intermediate diameter coil spring 12*b* and a small diameter coil spring 12*c* is housed in a supporting member 2 and resiliently provided between a cam slider 10 and a spring receiving member 11, with their respective both end portions being inserted into respective openings 10*b*, 11*b* of the cam slider 10 and the spring receiving member 11; in this manner, a cam portion 10*a* is in pressurized contact with a pressed member 5, while an abutting portion 11*a* with an actuating member 9. In the embodiment, the elastic member 12 uses three springs of different lengths and diameters, a large diameter coil spring 12*a*, an intermediate diameter coil spring 12*b* and a small diameter coil spring 12*c* are superposed on each other to urge the cam slider 10 and the spring receiving member 11 in directions where both mutually separate. The intermediate diameter coil spring 12*b* has a winding direction reverse to that of the large diameter coil spring 12*a* and the small diameter coil spring 12*c*. Second pressing portions 11*d*, 11*d* facing first pressing portions 2*j*, 2*j* of the supporting member 2 to press the latter are formed on a top portion of the spring receiving member 11 close to its center over a concave portion 11*c*. The pressing portions 11*d*, 11*d* are prolonged parallel to each other in an extension direction of the elastic member 12, as in the first pressing portions 2*j*, 2*j*.

Figure 8A:
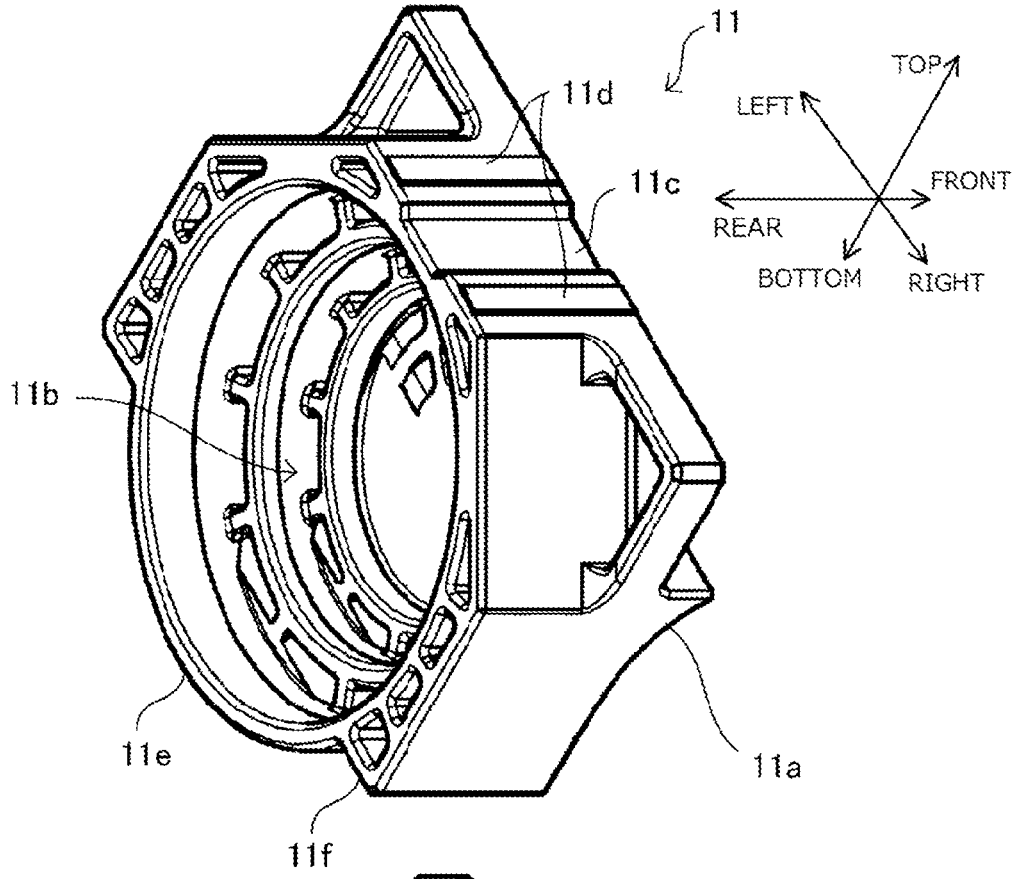
FIGS. 8A and 8B show a spring receiving member of a document cover closer according to the invention, FIG. 8A showing a perspective view as seen from the top on the rear side, and FIG. 8B—a perspective view as seen from the bottom on the front side.
Figure 8B:
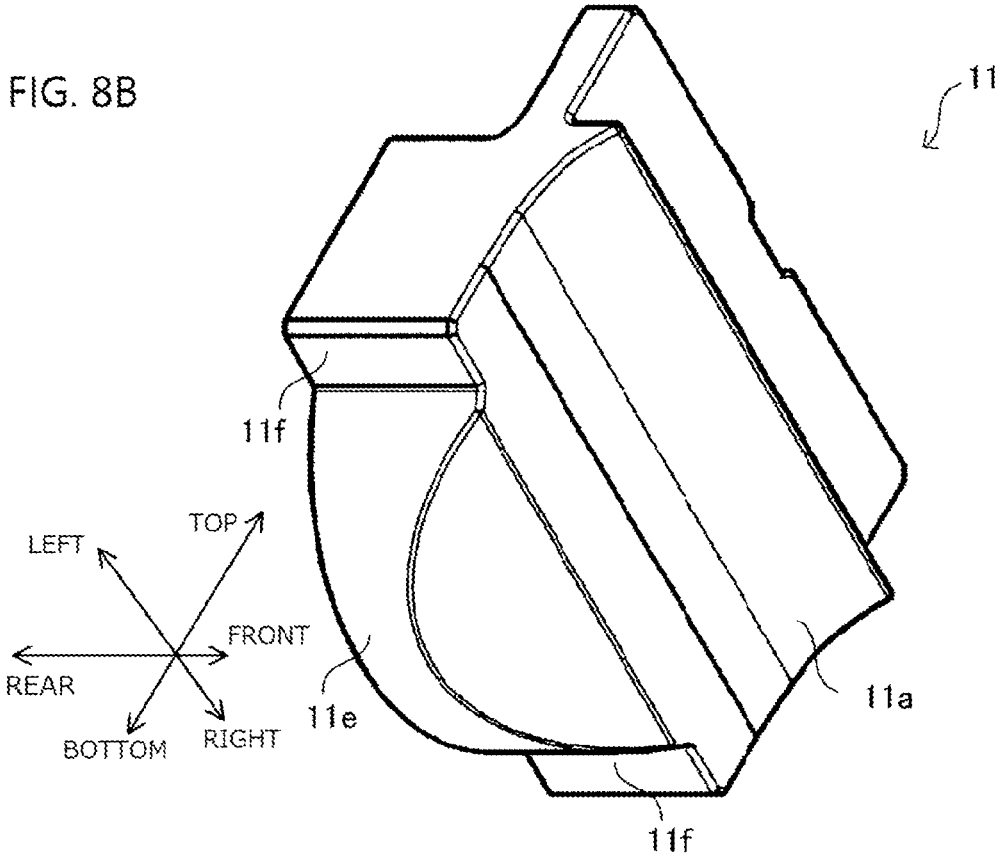
Figure 10A:
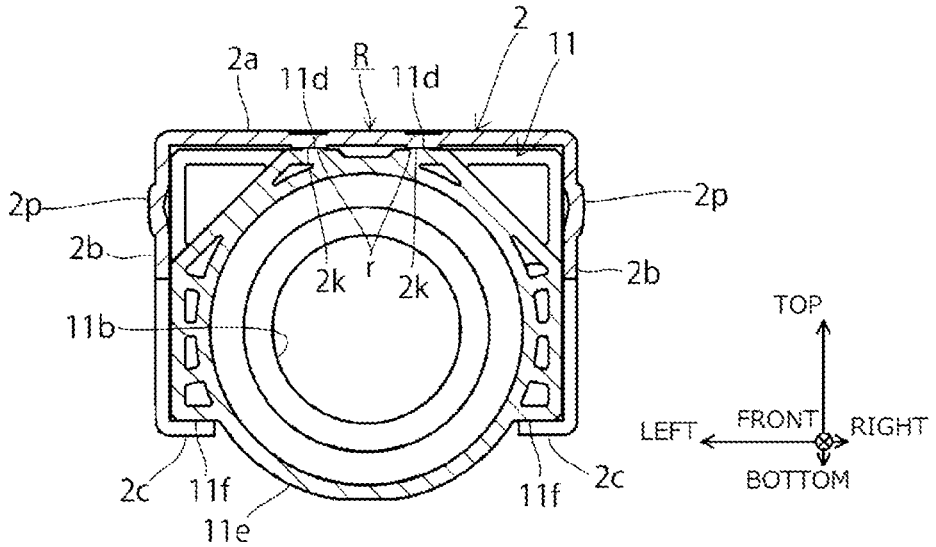
FIGS. 10A and 10B show a spring receiving member as slidably housed in a supporting member of a document cover closer according to the invention, FIG. 10A showing its elevation cross section and FIG. 10B—a spring receiving member and a supporting member arranged in a front-back direction as seen from its bottom surface.
Figure 10B:
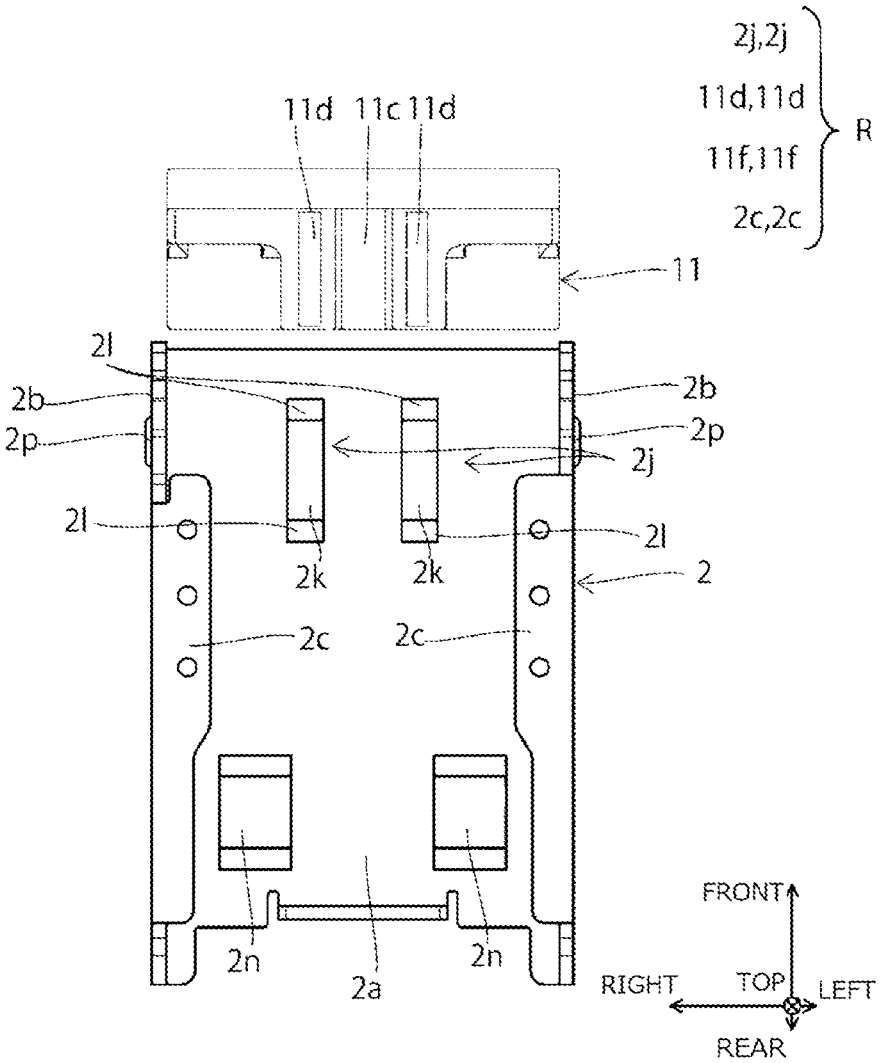

Still further, as shown in FIGS. 8A and 8B, a protruding portion 11*e* protruding downward in the arc shape and pressed portions 11*f*, 11*f* provided on the right and left of the protruding portion 11*e* are formed on a bottom portion of a spring receiving member 11. As shown in FIGS. 10A and 10B, the pressed portions 11*f*, 11*f* are pressed toward holding portions 2*c*, 2*c* by first pressing portions 2*j*, 2*j* and second pressing portions 11*d*, 11*d* being mutually pressed, the spring receiving member 11 being originally movably held by a supporting member 2 gets fitted with the latter to restrain a movement of one end (end portion toward an actuating member 9) of an elastic member 12 toward the other end (end portion toward a hinge shaft 3) and to restrain a separation of a lift member 6 and the supporting member 2. This can prevent a phenomenon of center folding of a document cover C. The first pressing portions 2*j*, 2*j*, the second pressing portions 11*d*, 11*d*, the pressed portions 11*f*, 11*f* and the holding portions 2*c*, 2*c* form a rotation resisting mechanism R for exhibiting a resistance to rotation while the lift member 6 is subject to a pressing force in a direction where it reversely rotates about a coupling shaft relative to the supporting member 2.

As shown in FIGS. 4, 9A and 9B, a cam slider 10 and an elastic member 12 is connected to each other via a fluid damper 13. The fluid damper 13 is a columnar element for restraining a sudden closing of a document cover C, and comprises a base portion 13*a* fitted with an opening 10*b*, a shaft portion 13*b* inserted into the elastic member 12 and a piston portion 13*c* capable of abutting against an opening 11*b*. The fluid damper 13 is intended to dampen a movement of the document cover to prevent a sudden closing by the piston 13*c* abutting against the opening 11*b* just before a complete closing of the document cover while it closes.

As shown in FIG. 4, an actuating member 9 comprises a flange portion 9*a*, and it is attached to both side plates 15*b*, 15*b* of a reinforcing member 15 and both side plates 6*b*, 6*b* of a lift member 6 by passing through attaching holes 15*d*, 15*d* and an actuating member attaching holes 6*e*, 6*e*. The actuating member 9 is a metallic round bar, but can be also constructed by providing a top plate on the lift member 6 and folding the top plate inwardly. In the meantime, the actuating member 9 can be also constructed to include an actuating pin and a cam cylindrical body with the actuating pin being inserted into an insertion hole provided in its axial direction.

The reinforcing member 15 comprises a base portion 15*a*, both side plates 15*b*, 15*b* directed in a rearward direction perpendicular to the base portion 15*a* and attaching holes 15*c*, 15*d* respectively formed on the both side plates 15*b*, 15*b*. The both side plates 15*b*, 15*b* of the reinforcing member 15 are attached to both side plates 5*b*, 5*b* of a lift member 5 using a coupling shaft 4 and an actuating member 9, and the reinforcing member is intended to restrain an outward opening of the both side plates of a lift member and to reinforce actuating member attaching holes 6*e*. In the meantime, the both side plates 15*b*, 15*b* of the reinforcing member 15 can be also attached the both side plates 5*b*, 5*b* of the lift member 5 using caulking pins, screws or others in this case.

A stopper plate 8 is attached to a rear plate 1*c* of an attaching member 1 by attaching screws 8*a*. The stopper plate 8 is composed of an attaching base plate portion 8*b* and stopper pieces 8*c*, 8*c* constructed by folding the attaching base plate portion 8*b* from its both side portions, and each of the stopper pieces 8*c*, 8*c* comprises a top portion 8*f*, 8*f* composed of a convex portion 8*d*, 8*d* and a concave portion 8*e*, 8*e*. A boss portion 1*k* fitted into a fixing hole 8*g* provided on the stopper plate 8 is provided on the rear plate 1*c*. An abutting portion 2*q* of an attaching portion 2 abuts against the concave portion 8*e* of the top portion 8*f*.

Figure 5A:
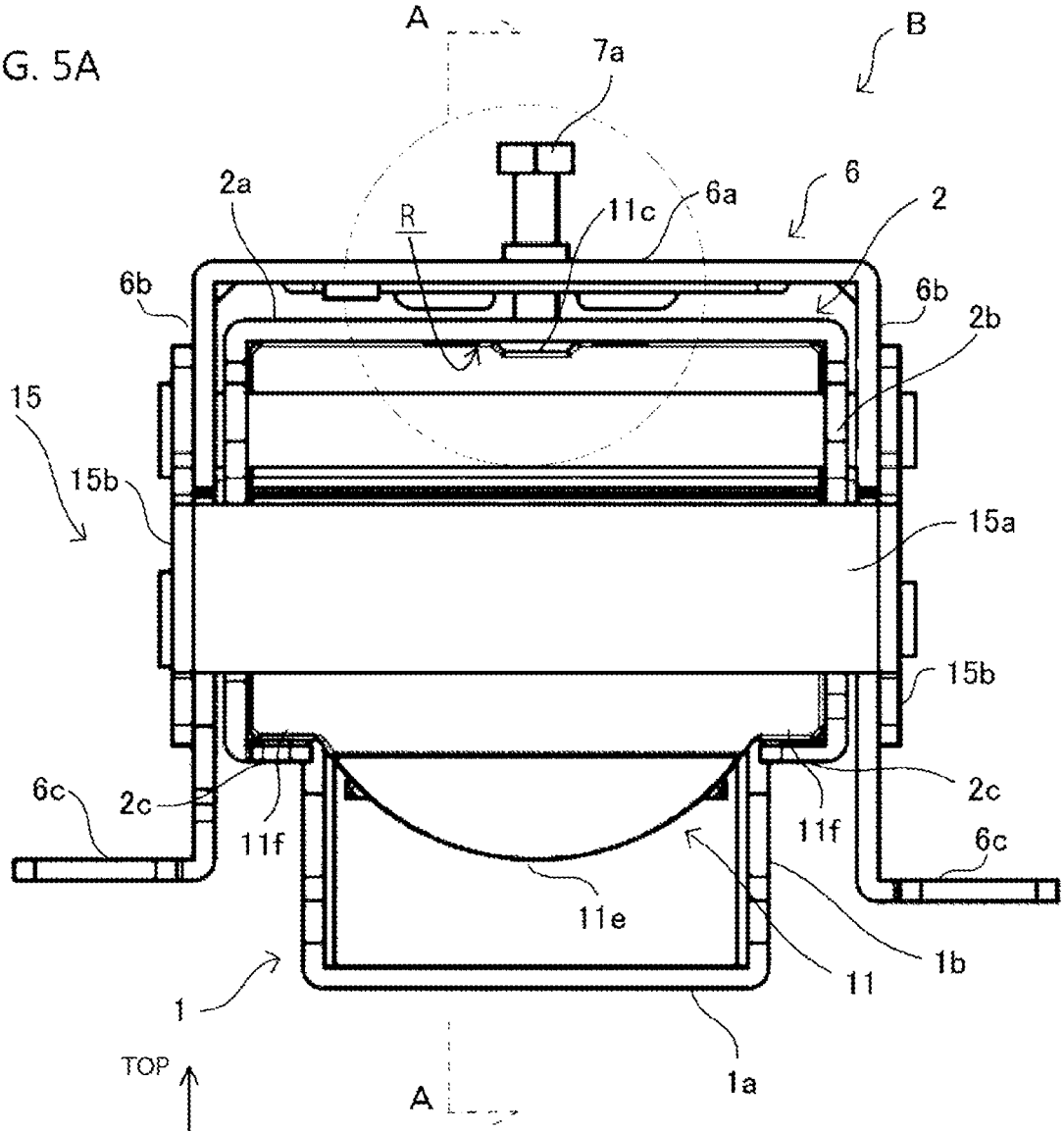
FIG. 5A shows an elevation view of a document cover closer according to the invention and FIG. 5B—an enlarged elevation view of a part denoted with O in dotted line of FIG. 5A.
Figure 5A:
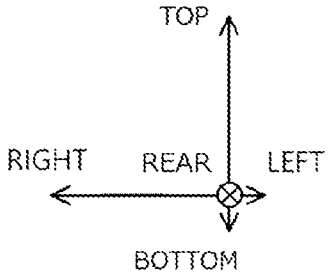
Figure 5B:
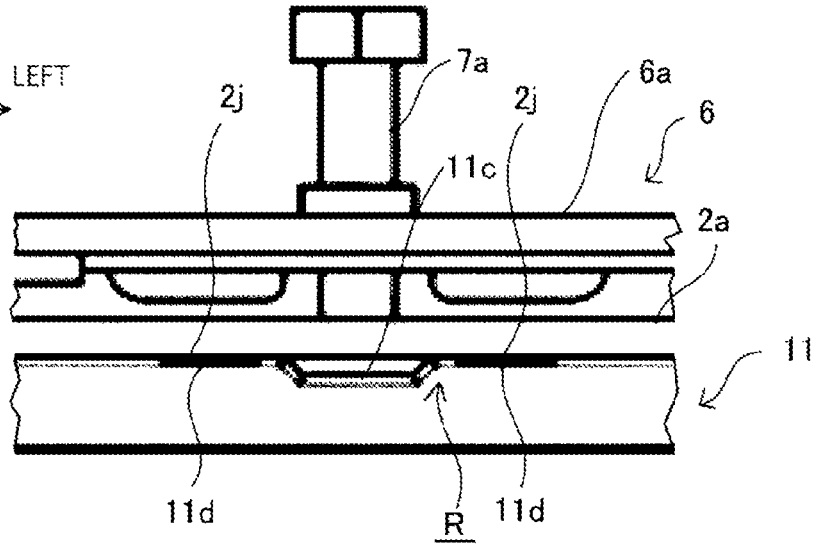
Figure 6:
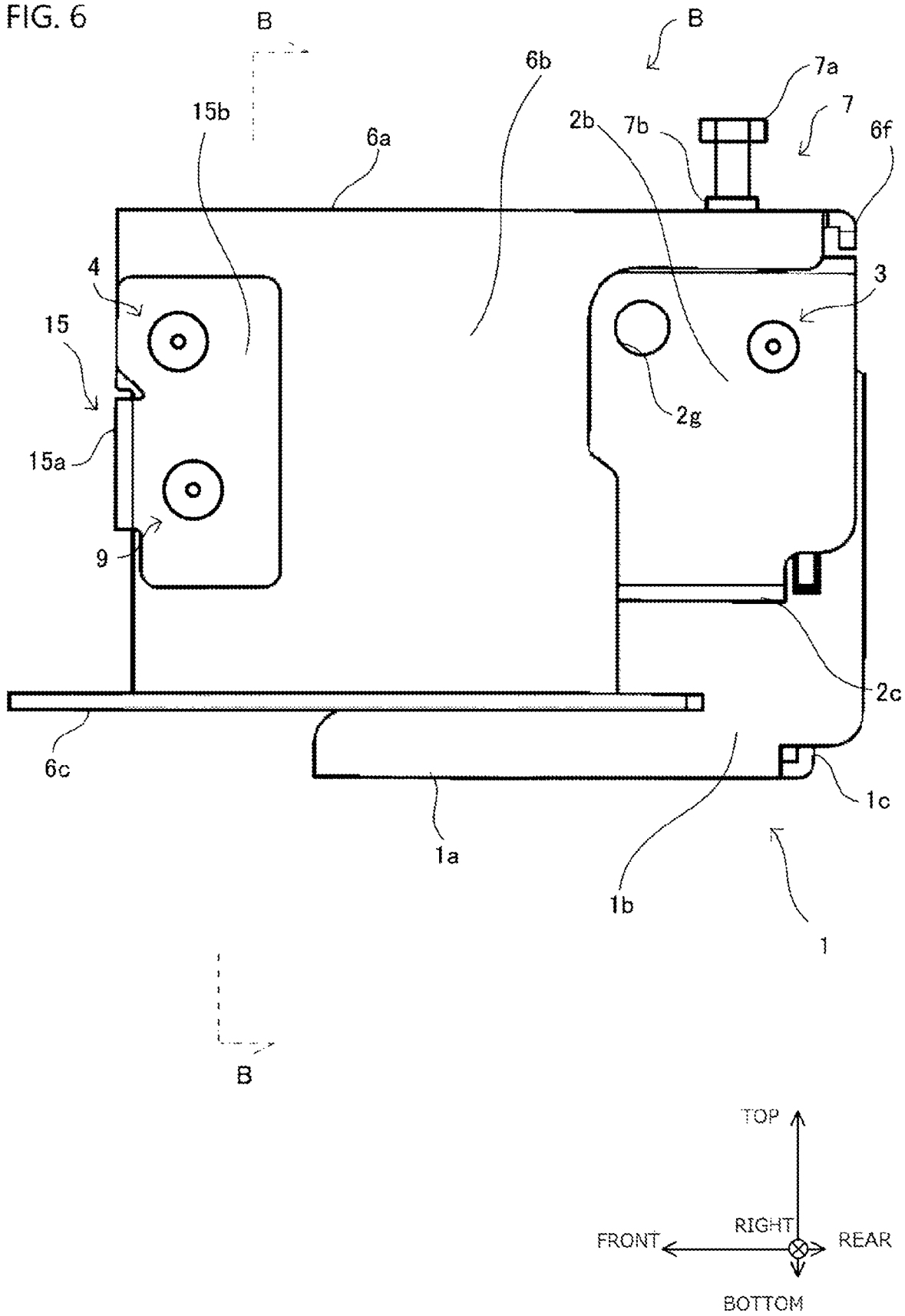
FIG. 6 shows a side view of a document cover closer according to the invention.
Figure 11:
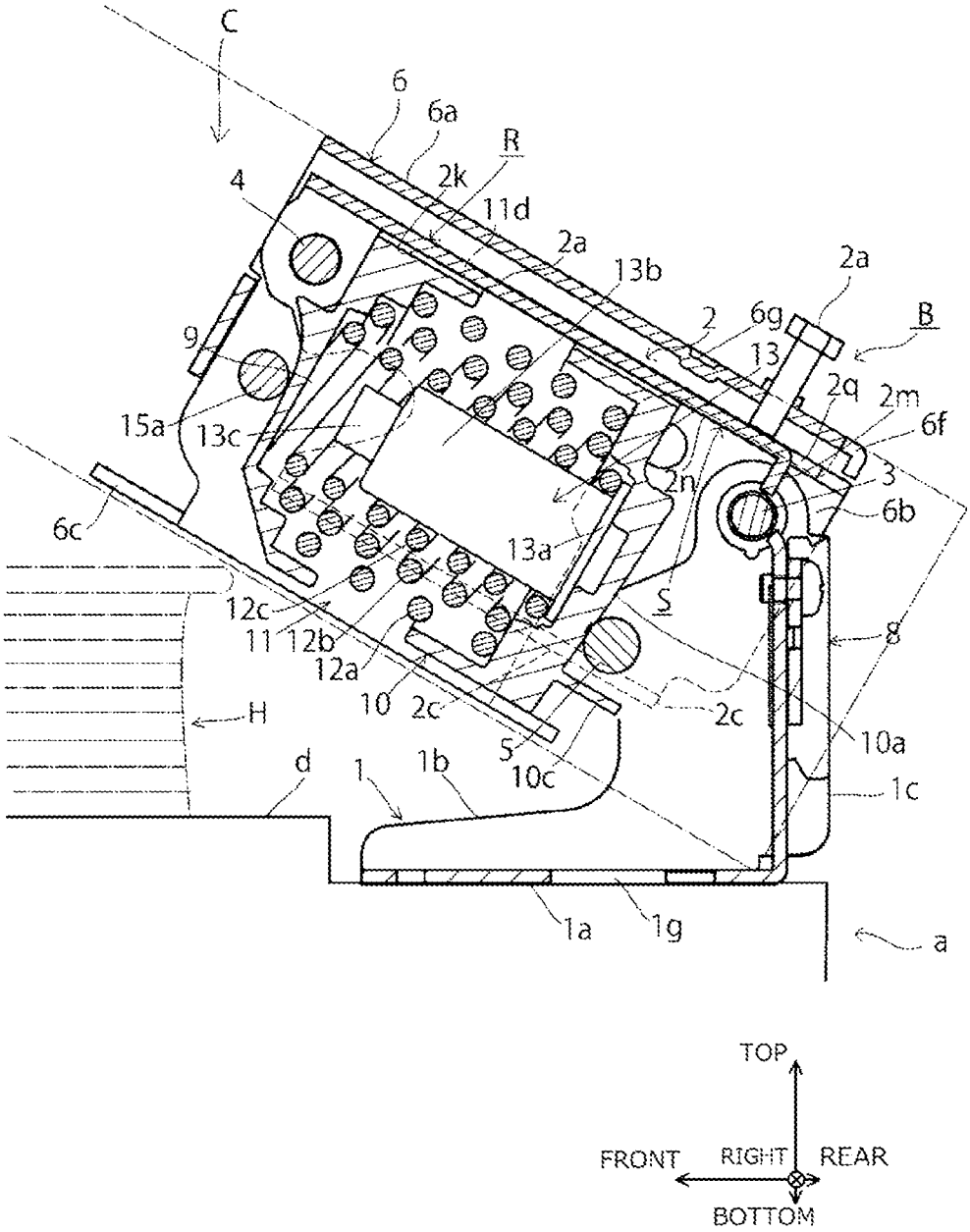
FIG. 11 shows a side cross section of a document cover closer according to the invention at a state opened at 45 degrees to illustrate its operation.

Next, an operation of the document cover closer B according to the embodiment 1 as described above is described. Here, as shown in FIGS. 9A and 9B, in the closed state of the document cover C, the document cover C is closed against the resilient force of the elastic member 12 mainly due to the weight of the document cover C to maintain the stable closed state. In the meantime, the action line of the elastic member 12 can be also shifted upward to rotatably urge the document cover C in the closing direction. Here in the closed state, as shown in FIGS. 5, 10A and 10B, the first pressing portions 2*j*, 2*j* and second pressing portions 11*d*, 11*d* forming the pressurizing contact mechanism r face each other to press each other, so that the pressed portions 11*f*, 11*f* of the spring receiving member 11 are pressed toward the holding portions 2*c*, 2*c* of the supporting member 2. As shown in FIG. 11, this state is maintained even when the opening angle of the document cover C is larger, so that the state where the lift member 6 and the supporting member 2 overlap each other is also maintained and a phenomenon of center folding of the document cover C can be restrained.

When the opening angle of the document cover C is getting larger from the state shown in FIGS. 9A and 9B, the abutting position of the cam portion 10*a* of the cam slider 10 shifts from high to low of the cam portion 10*a* with maintaining the contact state, the document cover C is opened by the resilient force of the elastic member 12 with its own weight being reduced. When the document cover C is opened at 10 degrees or greater, the pressed member 5 encounters at its abutting position the friction resistance moving higher on the cam portion 10*a* of the cam slider 10 urged by the elastic member 12 to slide in one direction, in order to counterbalance the rotation moment generated by the document cover C via the lift member 6 and the supporting member 2 with the rotation torque generated by the resilient force of the elastic member 12 and the pressed member 5 abutting against the cam portion 10*a* of the cam slider 10, so the document cover C stably stops and maintain the position without free fall, even if hands are off the document cover.

In the meantime, when the document cover C is vigorously opened, the resilient force from the elastic member 12 gets greater from the predetermined opening angle, so that the document cover C sometimes suddenly jumps up, i.e. the jump-up phenomenon occurs. This jump-up phenomenon is restrained by the projecting portions 2*n*, 2*n* formed at positions where they abut against the cam slider 10 at the predetermined opening angle pressing the cam slider 10 to the holding portion 2*c* as shown in FIG. 11, in order to exercise the braking effect and reduce the jump-up force, so that the jump-up phenomenon is restrained as much as possible. As the projecting portion 2*n* is constructed to comprise the protruding portion in the center and the inclined portions on the both sides as shown in FIGS. 4, 7A and 7B, the cam slider 10 contacts the projecting portion 2*n* with no impact accompanied with sudden rise, but the contact takes place smoothly and the braking force gradually increases.

When the document cover C once opened is getting closed, the document cover C is pressed downward in the closing direction, and then the contact area of the cam slider 10 with the projecting portion 2*n* shifts from the protruding portion to one of the inclined portions and the braking force gradually decreases, which assures the closing of the document cover C with the smaller force. Then, there is no contact area of the cam slider 10 with the projecting portion 2*n*, the document cover C is closed with rotating ab out the hinge shaft 3 of the document cover closer B. Here, the first pressing portions 2*j*, 2*j* and second pressing portions 11*d*, 11*d* face each other to press each other, so that the pressed portions 11*f*, 11*f* of the spring receiving member 11 are pressed toward the holding portions 2*c*, 2*c* of the supporting member 2, and the elastic member 12 presses the lift member 6 in a direction where the latter move to overlap the supporting member 2, so that the document cover C is normally closed without reversely rotating about the coupling shaft 4.

Still further, when the document cover C once opened is getting closed, the document cover C encounters a resistance when the pressed member 5 slides higher on the cam portion 10*a* against the resilient force of the elastic member 12; however, it is closed by the pressing force by hands, the weight of the document cover C and the inertial force, and then, when it is closed to the predetermined closing angle, e.g. 10 degrees, the moment of the document cover C in the closing direction begins to prevail to allow for an automatic closing even with hands off. Then, the tip of the shaft portion 13*b* of the fluid damper 13 starts to abut against the spring receiving member 11 in vicinity of the closing angle, and the damper starts to work, which allows to control the rotation of the supporting member 2 and to restrain the sudden closing of the document cover C.

Figure 12:
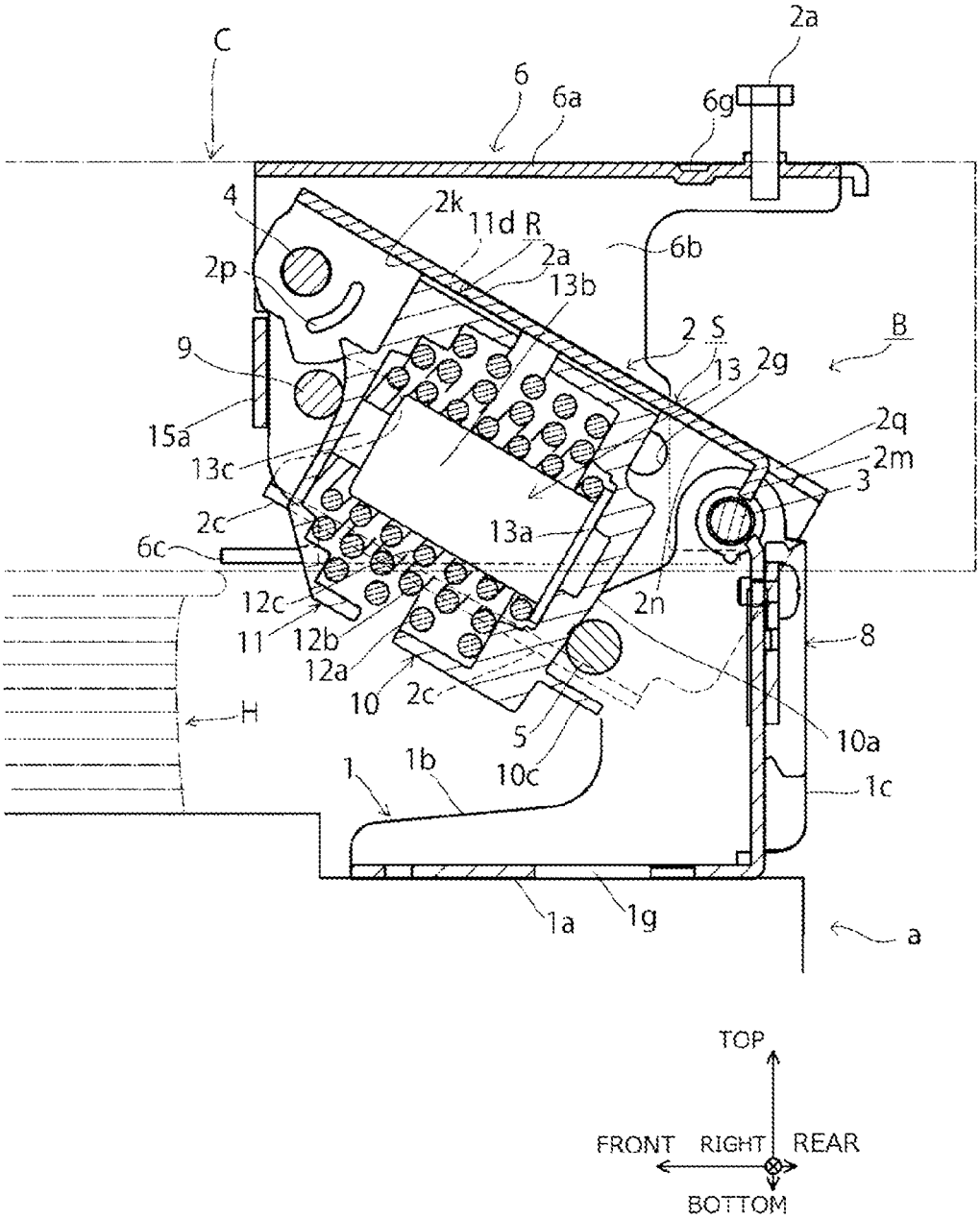
FIG. 12 shows a side cross section of a document cover closer according to the invention to illustrate its operation to handle a thick document.
Figure 13:
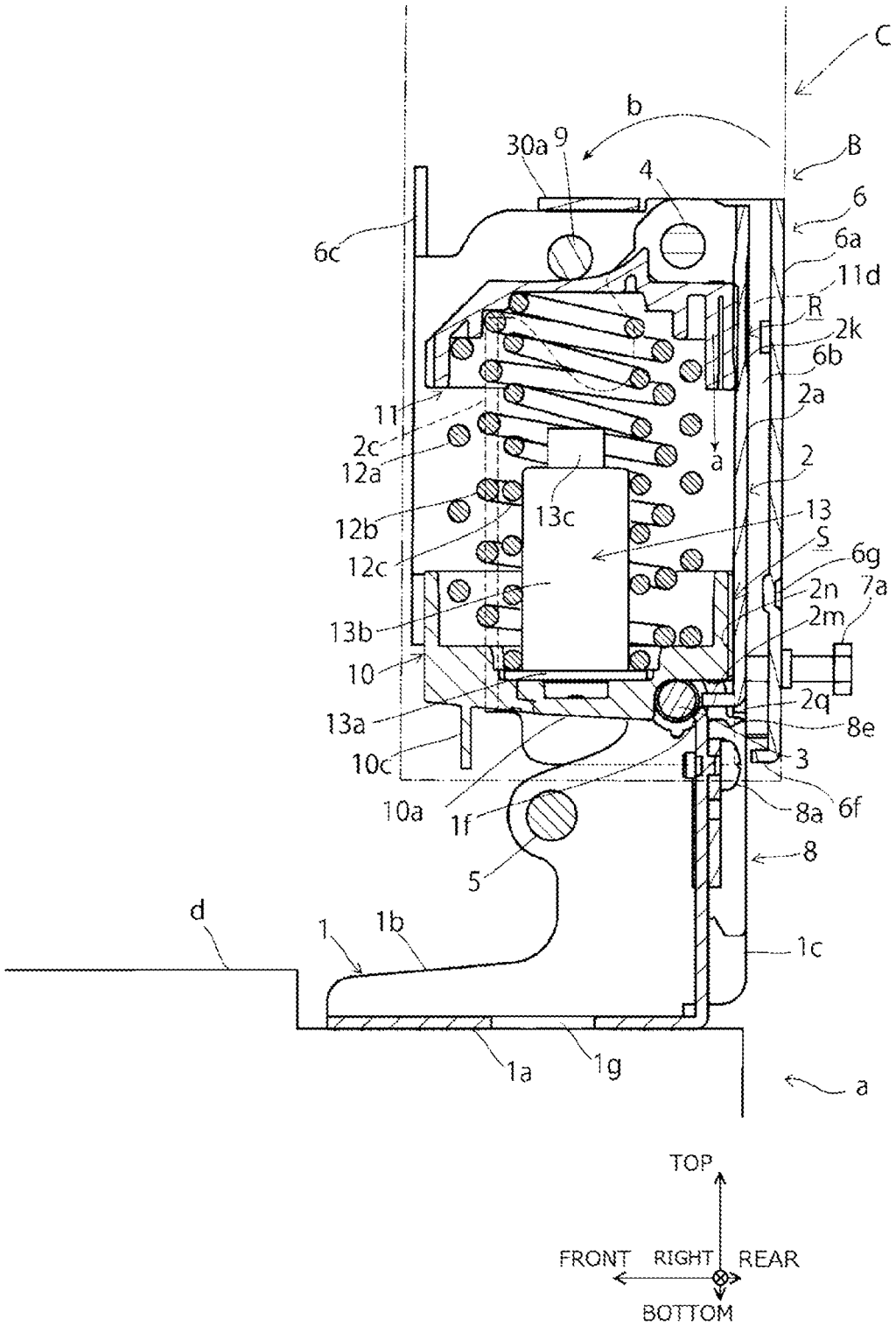
FIG. 13 shows a side cross section of a document cover closer according to the invention at a state opened at 90 degrees to illustrate its operation.
Figure 14:
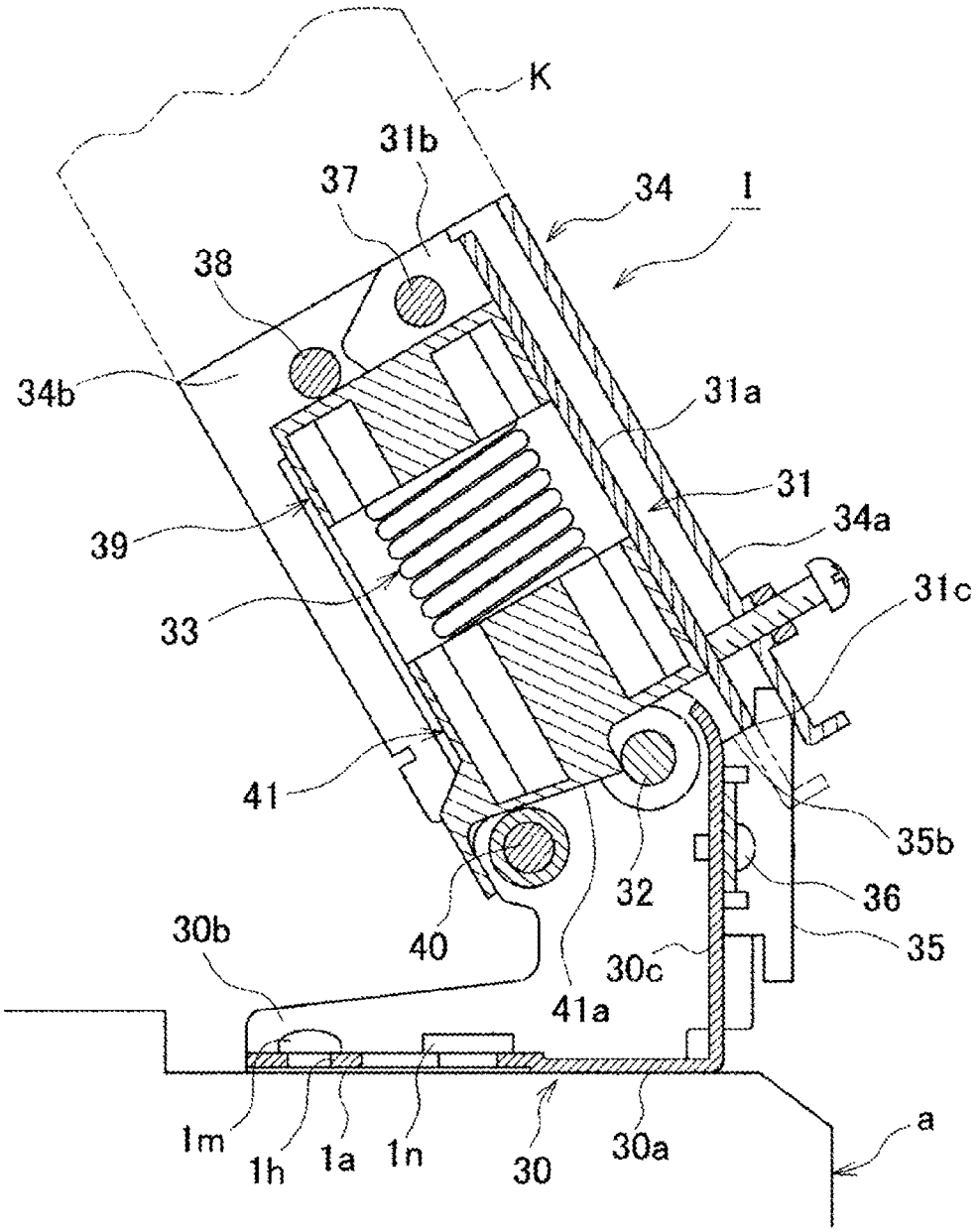
FIG. 14 shows a side cross section of a conventional document cover closer.

If the document is thick such as the book, the document cover C is pressed downward with the thick document H being placed on the platen glass (contact glass) d as shown in FIG. 12; then the spring receiving member 11 is pressed by the actuating member 9 attached to the both side plates 6*b*, 6*b* of the lift member 6 reversely rotating about the coupling shaft 4, the supporting member 2 is released from pressing by the spring receiving member 11, or by the first pressing portions 2*j*, 2*j* and the second pressing portions 11*d*, 11*d* to slide toward the cam slider 10 against the resilient force of the elastic member 12 and the document cover C rotates together with the lift member 6 about the coupling shaft 4 to cover the top surface of the thick document H. In order to release the supporting member 2 from pressing by the spring receiving member 11, the position of facing of the first pressing portions 2*j*, 2*j* and the second pressing portions 11*d*, 11*d* shifts from the protruding portions 2*k*, 2*k* rearward to the inclined portions 2*l*, 2*l* to gradually decrease the pressing force of the first pressing portions 2*j*, 2*j* and the second pressing portions 11*d*, 11*d* as well as the force working while the spring receiving member 11 presses the holding portions 2*c*, 2*c* of the supporting member 2.

Then, the first pressing portions 2*j*, 2*j* and second pressing portions 11*d*, 11*d* cease to face each other to press each other, so that the spring receiving member 11 is not pressed toward the holding portions 2*c*, 2*c* of the supporting member 2. This structure enables to prevent the phenomenon of center folding, to increase the resistance only at the start of the lift operation, and to decrease the resistance (ensure the lift operation only using the normal force) otherwise. Therefore, the document cover closer B according to the invention ensures that the document is stably in press contact with the top surface of the platen glass d regardless of its thickness, and thus especially in case of the thick document H, prevents as much as possible the external light from entering through the platen glass (contact glass) d into the exposure system inside the main body.

As described above, the document cover closer B according to the invention comprises the attaching member 1 comprising the attaching base 1*a* and the both side plates 1*b*, 1*b* erected from both sides of the attaching base 1*a*, wherein the attaching member 1 is attached to the main body; the supporting member 2 comprising the back plate 2*a* and the both side plates 2*b*, 2*b* directed downward from the both end portions of the back plate 2*a*, wherein its both side plates 2*b*, 2*b* are rotatably coupled via the hinge shaft 3 to the both side plates 1*b*, 1*b* of the attaching member 1; the lift member 6 for attaching the document cover C comprising the back plate 6*a* and the both side plates 6*b*, 6*b* directed downward from both side end portions of the back plate 6*a*, wherein the both side plates 6*b*, 6*b* are pivotally attached via the coupling shaft 4 to the free end side of the both side plates 2*b*, 2*b* of the supporting member 2 to be rotatable in the direction different from the rotation direction of the supporting member 2; the actuating member 9 provided on the pivotally attaching portion of the lift member 6 so as to rotate about the coupling shaft 4 when the lift member 6 rotates; and the elastic member 12 resiliently provided between the actuating member 9 and the attaching member 1 to rotationally urge the lift member 6 in a direction in which the latter moves to overlap the supporting member 2, while urging the supporting member 2 in the opening direction of the document cover C. Then, the rotation resisting means R is provided for exhibiting the resistance to rotation when the lift member 6 is subject to the pressing force in the direction of the reverse rotation thereof relative to the supporting member 2 about the coupling shaft 4. In this manner, the elastic member 12 resiliently provided between the actuating member 9 and the attaching member 1 rotationally urges the lift member 6 in a direction in which the latter moves to overlap the supporting member 2, while urging the supporting member 2 at least in the opening direction of the document cover C, the rotation resisting means R exhibits the resistance to rotation when the lift member 6 is subject to the pressing force in the direction of the reverse rotation thereof relative to the supporting member 2 about the coupling shaft 4. Therefore, the separation of the lift member 6 and the supporting member 2 about the coupling shaft 4 is restrained to prevent the phenomenon of center folding and decrease the operation force during the lift except its start as in the normal operation.

According to the embodiment as described above, the second pressing portions 11*d* facing the first pressing portions 2*j* to press the spring receiving member 11 to the supporting member 2 are formed on the spring receiving member 11; the first pressing portions 2*j* and the second pressing portions 11*d* form the pressing mechanism r to press the spring receiving member 11 to the holding portion 2*c* formed on the supporting member 2. Therefore, the document cover closer B can prevent the phenomenon of center folding of the document cover C in the normal opening and closing operation, and decrease the operation force except the start of its operation as in the normal operation.

According to the embodiment as described above, the first pressing portions 2*j* are formed on the back plate 2*a* of the supporting member 2, the second pressing portions 11*d* on the top end of the spring receiving member 11 and the holding portion 2*c* extend along the extension direction of the elastic member 12 on the lower ends of the both side plates 2*b* of the supporting member 2 and formed to face the back plate 2*a* of the supporting member 2, so that the spring receiving member 11 are pressed by the first pressing portions 2*j* and the second pressing portions 11*d* toward the holding portion 2*c*. Therefore, it can prevent the phenomenon of center folding of the document cover in the normal opening and closing operation, and decrease the operation force except the start of its operation as in the normal operation.

According to the embodiment as described above, the pressing mechanism r consisting of the first pressing portions 2*j* and the second pressing portions 11*d* are formed by the arrangement of plurality of the projecting portions in parallel to each other on each of the pressing portions to stably press each other when the lift member 6 and the supporting member 2 overlap each other. Therefore, it can prevent a phenomenon of center folding of the document cover in the normal opening and closing operation, and decrease the operation force except the start of its operation as in the normal operation.

According to the embodiment as described above, the projecting portions are prolonged along the extension direction of the elastic member 12 to enable the first pressing portions 2*j* and the second pressing portions 11*d* to stably press each other when the lift member 6 and the supporting member 2 overlap each other, so that it can prevent the phenomenon of center folding of the document cover C in the normal opening and closing operation, and decrease the operation force except the start of its operation as in the normal operation.

Still further, according to the embodiment as described above each of the projecting portions 2*n* of the first pressing portions 2*j* comprises the protruding portion 2*k* protruding the most and the inclined portions 2*l* provided on the both ends of the protruding portion 2*k* in the extending direction of the elastic member 12 with protrusion increasing or decreasing along the extending direction of the elastic member 12; in this manner, the spring receiving member 11 is pressed toward the holding portions 2*c*, so that it can smoothly decrease the operation force during the lift as in the normal operation, when it is released from the fitting state.

According to the embodiment as described above, the projecting portions 2*n* of the first pressing portions 2*j* are prolonged along the extending direction of the elastic member 12, so that the first pressing portions 2*j* and the second pressing portions 11*d* can stably press each other, which enables to prevent the phenomenon of center folding of the document cover C in the normal opening and closing operation, and to decrease the operation force except the start of its operation as in the normal operation.

Still further, according to the embodiment as described above, the projecting portions 2*n* press the cam slider 10 toward the holding portion 2*c* so that the sudden movement of the cam slider 10 can be restrained when the document cover C is opened, which enables to restrain the jump-up phenomenon.

Still further, according to the embodiment as described above, the reinforcing member 15 is put over the both side plates 6*b*, 6*b* of the lift member 6, and attached to the lift member 6 by the coupling shaft 4 and the actuating member 6. Therefore, no further element has to be used for attaching the reinforcing member 15, it can restrain the separation of the both side plates 6*b*, 6*b* of the lift member 6 with a smaller number of parts, so that a highly reinforced document cover closer B can be constructed to have a reduced volume and weight.

According to the embodiment as described above, the document cover closer B described above is used in the multifunction printer A being office equipment between the main body a and the document cover C to be able to prevent a phenomenon of center folding of the document cover C in the normal opening and closing operation, and to decrease the operation force except the start of its operation as in the normal operation.

In the document cover closer B according to the embodiment as described above, pressing portions are formed respectively on the supporting member 2 and the spring receiving member 11, but they can be formed on only one of the supporting member and the spring receiving member.

Still further, in the embodiment as described above, two each of the pressing portions are formed respectively on the supporting member 2 and the spring receiving member 11, but one each of them can be formed on only one of the supporting member and the spring receiving member, or one of them on only one of the supporting member and the spring receiving member. Otherwise three or more of the pressing portions can be formed respectively on the supporting member and the spring receiving member. Otherwise the numbers of the pressing portions can be different on the supporting member and the spring receiving member, for example one of the pressing portions is formed on the supporting member and two on the spring receiving member so that one pressing portion on the supporting member and two pressing portions on the spring receiving member press each other.

In the embodiment as described above, the two each projecting portions of the first pressing portions 2*j*, 2*j* and the second pressing portions 11*d*, 11*d* are arranged in parallel to each other, but only two projecting portions of one of the first pressing portions and the second pressing portions are formed in parallel, while the remaining two projecting portions of the other can be arranged to have a narrower or wider distance to each other in the extending direction of the elastic member 12, or each pair of the projecting portions can be arranged to have a narrower or wider distance to each other, with a degree of narrowing or widening different from the other pair. Convex portions capable of fitting with concave portions can be formed.

In the embodiment as described above each of the projecting portions 2*n* of the first pressing portions 2*j*, 2*j* comprises the protruding portion 2*k*, 2*k* protruding the most and the inclined portions 2*l*, 2*l*, 2*l*, 2*l* provided on the both ends of the protruding portion 2*k*, 2*k* in the extending direction of the elastic member 12 with protrusion increasing or decreasing along the extending direction of the elastic member 12, but the projecting portions can be formed to have an increasing protrusion along the extending direction of the elastic member 12.

In the embodiment as described above the first pressing portions 2*j*, 2*j* and the second pressing portions 11*d*, 11*d* are configured to have their projecting portions pressing each other, but instead of one of the projecting portions of the first pressing portions 2*j*, 2*j* and the second pressing portions 11*d*, 11*d*, concave portions and convex portions capable of fitting with the concave portions when the lift member 6 and the supporting member 2 overlap each other can be formed.

Still further in the embodiment as described above, the distance between the projecting portions 2*n*, 2*n* is greater than that between the first pressing portions 2*j*, 2*j*, but the distance between the first pressing portions 2*j*, 2*j* (and between the second pressing portions 11*d*, 11*d*) can be equal to or greater than the distance between the projecting portions 2*n*, 2*n*.

In the meantime, as an alternative embodiment of the rotation resisting mechanism R, it can be constructed by providing a click stop mechanism for allowing for a mutual pressurized contact state of the lift member 6 and the supporting member 2 when their respective both side plates 6*b*, 6*b*; 2*b*, 2*b* overlap each other on an area for coupling the lift member 6 with the supporting member 2 using the coupling shaft 4, engaging or pressing means working when the lift member 6 and the supporting member 2 overlap each other can be formed between the respective both side plates 6*b*, 6*b*; 2*b*, 2*b*.

In the meantime, as an alternative embodiment of the rotation resisting mechanism R of the lift member 6, it can be provided between the actuating member 9 on one hand, and the guide grooves 2*d*, 2*d* provided on the both side plates 2*b*, 2*b* of the supporting member 2 into which the actuating member 9 is inserted on the other, by narrowing the width e.g. of the inlet portions of the guide grooves 2*d*, 2*d*.

Since the invention is constructed as described in the foregoing, it is suitably used as a document cover closer for office equipment such as copying machine or multifunction printer comprising a lift member attached on a free end portion of a supporting member rotatably attached to an attaching member to be rotatable in a direction where it moves to overlap the supporting member, and as office equipment using the document cover closer.

What is claimed is:

1. A document cover closer comprising:

an attaching member comprising an attaching base and both side plates directed upward from both sides of said attaching base, said attaching member being attached to a main body having a platen glass;

a supporting member comprising at least a back plate and both side plates directed downward from the back plate, wherein said both side plates being rotatably coupled via a hinge shaft to said both side plates of said attaching member;

a lift member for attaching a document cover comprising at least a back plate and both side plates directed downward from said back plate, said both side plates of said lift member being pivotally attached via a coupling shaft to be rotatable in a direction different from that of said supporting member on the free end of said both side plates of said supporting member and said lift member comprising an actuating member on a pivotally attaching portion;

a cam slider slidably provided in the supporting member in contact with a pressed member provided between the both side plates of the attaching member, said cam slider being held by a holding portion of the supporting member;

a spring receiving member slidably provided toward said coupling shaft on said supporting member, said spring receiving member being held by the holding portion;

an elastic member rotationally urging said supporting member via said actuating member in an opening direction of said document cover;

said actuating member in contact with said spring receiving member provided on said pivotally attaching portion of said lift member relative to said supporting member, said document cover closer further comprising rotation resisting means exhibiting resistance to rotation when said lift member is subject to a pressing force in a direction of a reverse rotation thereof relative to said supporting member about said coupling shaft, in order to horizontally cover a top side of a thick document; and said rotation resisting means are composed of a pressurizing contact mechanism for bringing together said supporting member and said spring receiving member, when said supporting member and said lift member overlap each other.

2. The document cover closer according to claim 1, wherein said pressurizing contact mechanism is composed of first pressing portions provided on a bottom facing surface of said back plate of said supporting member, and of second pressing portions provided on said spring receiving member at a position where said spring receiving member is in pressurized contact with said first pressing portion.

3. The document cover closer according to claim 2, wherein said first pressing portion and said second pressing portion are respectively a plurality of ridges arranged in parallel to extend in parallel to each other.

4. The document cover closer according to claim 1, wherein said pressurizing contact mechanism is composed of a convex portion or concave portion provided on a tip portion toward a bottom portion, and of a concave portion or convex portion fitting said convex portion or concave portion provided toward said spring receiving member at a position where said spring receiving member is in pressurized contact with said first pressing portion.

5. The document cover closer according to claim 1, wherein said rotation resisting means are provided between said supporting member and said lift member to increase a resistance to a rotation of said lift member while said lift member rotates relative to said supporting member.

6. The document cover closer according to claim 1, wherein said rotation resisting means are provided between said actuating member and said supporting member to increase a resistance to a rotation of said actuating member while said lift member starts to rotate relative to said supporting member.

7. The document cover closer according to claim 6, wherein while providing said rotation resisting means between said actuating member and said supporting member, said rotation resisting means are composed of guide grooves provided on said both side plates of said supporting member and of said actuating member to be inserted into said guide grooves.

8. The document cover closer according to claim 1, wherein a reinforcing member is attached to said lift member over a space between said both side plates thereof.

9. The document cover closer according to claim 1, wherein a braking mechanism starting to have an effect from a predetermined opening angle of said supporting member is provided between said supporting member and said cam slider.

10. The document cover closer according to claim 9, wherein said braking mechanism is a projecting portion provided toward a bottom portion of said back plate of said supporting member to be directed to said cam slider.

11. Office equipment wherein a document cover closer according to claim 1 is used between a main body and a document cover.

* * * * *